US009022304B2

(12) United States Patent
Nishida et al.

(10) Patent No.: US 9,022,304 B2
(45) Date of Patent: May 5, 2015

(54) FUEL INJECTION VALVE OF DIRECT INJECTION ENGINE

(71) Applicant: Mazda Motor Corporation, Aki-gun, Hiroshima (JP)

(72) Inventors: Masami Nishida, Hiroshima (JP); Keiji Gotoh, Higashihiroshima (JP); Takao Miyazaki, Hiroshima (JP)

(73) Assignee: Mazda Motor Corporation, Hiroshima (JP)

( * ) Notice: Subject to any disclaimer, the term of this patent is extended or adjusted under 35 U.S.C. 154(b) by 47 days.

(21) Appl. No.: 13/914,503

(22) Filed: Jun. 10, 2013

(65) Prior Publication Data

US 2014/0001290 A1 Jan. 2, 2014

(30) Foreign Application Priority Data

Jun. 29, 2012 (JP) ..... 2012-146741

(51) Int. Cl.

| | |
|---|---|
| ***F02M 51/06*** | (2006.01) |
| ***F02M 61/10*** | (2006.01) |
| ***F02M 63/00*** | (2006.01) |
| *F02M 61/16* | (2006.01) |
| *F02M 61/18* | (2006.01) |

(52) U.S. Cl.

CPC ..... *F02M 61/10* (2013.01); *F02M 51/0617* (2013.01); *F02M 51/0671* (2013.01); *F02M 63/0063* (2013.01); *F02M 51/0685* (2013.01); *F02M 61/166* (2013.01); *F02M 2200/8061* (2013.01); *F02M 2200/03* (2013.01); *F02M 2200/08* (2013.01); *F02M 51/0682* (2013.01); *F02M 61/1853* (2013.01); *F02M 61/1813* (2013.01)

(58) Field of Classification Search

CPC ..... F02M 51/0617; F02M 51/0671; F02M 51/0682; F02M 51/0685; F02M 61/10; F02M 61/166; F02M 61/1813; F02M 61/1853; F02M 63/0063; F02M 2200/03; F02M 2200/08; F02M 2200/8061

USPC ..... 239/533.2, 533.9, 585.1–585.5; 123/472

See application file for complete search history.

(56) References Cited

U.S. PATENT DOCUMENTS

| | | | | |
|---|---|---|---|---|
| 4,216,454 | A * | 8/1980 | Ohtani et al. | 335/262 |
| 2003/0141390 | A1 * | 7/2003 | Matsuo et al. | 239/585.1 |

FOREIGN PATENT DOCUMENTS

| | | | |
|---|---|---|---|
| EP | 2302197 | A1 | 3/2011 |
| JP | 2010019194 | A | 1/2010 |

* cited by examiner

*Primary Examiner* — Darren W Gorman

(74) *Attorney, Agent, or Firm* — Alleman Hall McCoy Russell & Tuttle LLP

(57) ABSTRACT

A fuel injection device of a direct injection engine is provided. The device includes an engine body, a fuel injection valve, and a controller for controlling a fuel injection by the fuel injection valve. The fuel injection valve has a nozzle hole, a valve body for opening and closing the nozzle hole, and first and solenoid coils for stroking the valve body by first and second stroke amounts, respectively. The controller performs the fuel injection by the first solenoid coil in an intake stroke period within an engine operating range with an engine load below a predetermined load. The controller performs the fuel injection with a fuel pressure of 40 MPa or above by the second solenoid coil in a period between a compression stroke late stage and an expansion stroke early stage within a low-engine-speed range with an engine speed below a predetermined speed and within a high-engine-load range.

5 Claims, 15 Drawing Sheets

FUEL INJECTION VALVE OF DIRECT INJECTION ENGINE

BACKGROUND

The present invention relates to a fuel injection valve of a direct injection engine.

For example, EP2302197A1 (JP2010-019194A) discloses a solenoid-operated fuel injection valve. The fuel injection valve opens outwardly, and includes a cylindrical case partitioning a fuel passage within a valve body, and a movable core provided to be movable inside the case in a cylinder axial direction and for stroking a valve body for opening and closing a nozzle hole. The fuel injection valve also includes a solenoid coil arranged on the outside of the case and for attracting the movable core by forming a magnetic circuit over the inside and outside of the case during a power supply to the solenoid coil, so that the valve body opens the nozzle hole.

Since the fuel injection valve disclosed in EP2302197A1 (JP2010-019194A) directly injects fuel inside a cylinder of an engine, fuel pressure is set comparatively high. Since the case partitioning the fuel passage receives an internal pressure corresponding to the fuel pressure, sufficient strength for withstanding the internal pressure is required for the case. Accordingly, the strength required for the case increases as the set fuel pressure is higher.

In a solenoid-operated fuel injection valve, the case constitutes a part of the magnetic circuit. Therefore, the case is constituted by a material with high magnetic permeability and low residual magnetism, such as ferritic metal. However, ferritic metal is inconvenient in terms of strength. Therefore, when the fuel pressure is set high, the case needs to be thickened significantly so as to satisfy the required strength. However, if the case is thickened too much, then the magnetic circuit formed over the inside and outside of the case cannot be formed. Thus, the solenoid-operated fuel injection valve has a problem that it is difficult to increase the fuel pressure.

The present invention is made in view of the above situations and provides a solenoid-operated fuel injection valve in which setting of high fuel pressure is available.

SUMMARY

The present invention relates to a fuel injection valve of a direct injection engine for directly injecting fuel containing gasoline into a cylinder of the engine.

The fuel injection valve includes a valve body formed at a tip end thereof, with a nozzle hole facing inside the cylinder, a cylindrical case arranged inside the valve body and forming a fuel passage by an inner circumferential surface of the case, a needle body for opening and closing the nozzle hole, a movable core movably provided inside the case in along the cylinder axial direction and for driving the needle body to open and close, and a solenoid coil arranged outside the case and for attracting the movable core by forming a magnetic circuit over the inside and outside of the case when power is supplied to the solenoid coil, so that the valve body opens the nozzle hole.

A maximum fuel pressure inside the fuel passage fuel injection valve is set to a high fuel pressure of 40 MPa or above, and the fuel injection valve further includes a reinforcing member fitted externally onto the case.

According to this configuration, when power is supplied to the solenoid coil, the magnetic circuit is formed over the inside and outside of the case, the movable core is attracted by the circuit so that the needle body opens the nozzle hole.

Thus, the fuel inside the fuel passage formed by an inner circumferential surface of the case is injected through the nozzle hole into the cylinder of the engine. Here, the needle body may be a needle valve for being seated on a seat surface formed inside the valve body, and being separated from the seat surface by the movable core being attracted so as to open the nozzle hole formed penetrating in the tip end of the valve body. The needle body may alternatively be an outward opening valve for being seated on a seat surface formed outside the valve body, and being separated outwardly from the seat surface by the movable core being attracted so as to open the nozzle hole in a ring shape.

Further, according to the above configuration, since the maximum fuel pressure inside the fuel passage is set to the high fuel pressure of 40 MPa or above, the case may receive a high internal pressure due to the high fuel pressure. However, the reinforcing member fitted externally onto the case, exerts an inward resistance force acts on the case from outside in a radial direction thereof, and the case can withstand the high internal pressure. Further, unlike thickening the case to increase the strength thereof, by applying a dual tube structure to the case, a stress can be dispersed to the two inside and outside tubes (i.e., the case and the reinforcing member). As a result, a required strength can be secured without thickening the case, which means with a comparatively thin case, a part of the magnetic circuit can be formed over the inside and outside of the case. Thus, the high fuel pressure can be set for the solenoid-operated fuel injection valve.

The reinforcing member may include a magnetic body arranged adjacent to the solenoid coil in the cylinder axial direction and constituting a part of the magnetic circuit. In this way, increase in fuel pressure by the reinforcement of the case and the formation of the magnetic circuit may both be achieved, therefore, the high fuel pressure can be set for the solenoid-operated fuel injection valve.

The magnetic body may be made up of ferrite steel. Since ferrite steel has high magnetic permeability and low residual magnetism, it is advantageous in improving the performance of the fuel injection valve.

The reinforcing member may include a non-magnetic body intervening between the solenoid coil and the case.

If the reinforcing member intervening between the solenoid coil and the case includes a magnetic body, the magnetic circuit may take a short cut, and the movable core inside the case cannot be attracted. Specifically, by including the non-magnetic body in the reinforcing member intervening between the solenoid coil and the case, the magnetic circuit can be formed over the inside and outside of the case and, thus, the movable core can be attracted to the magnetic circuit.

The non-magnetic body may be made of austenite steel. The austenite steel is high in strength, so it is advantageous in reinforcing the case. Also, the reinforcing member intervening between the solenoid coil and the case can be thinned. Thus, the gap between the solenoid coil and the case can be narrowed, and therefore, it is advantageous in forming a magnetic circuit with high efficiency.

DETAILED DESCRIPTION OF EMBODIMENTS

Figure 1:
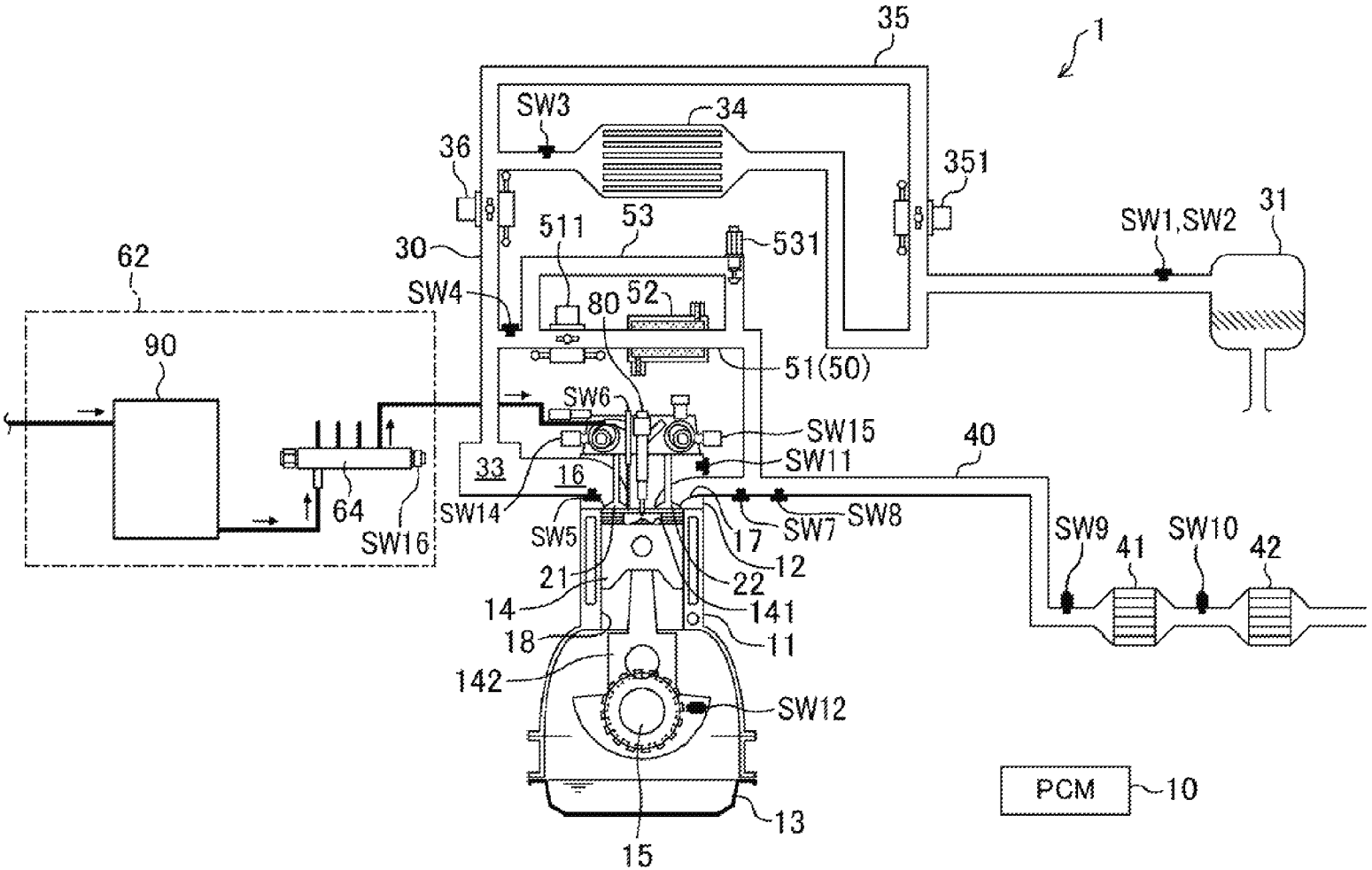
FIG. 1 is a schematic diagram showing a configuration of a spark-ignition direct-injection gasoline engine.
Figure 2:
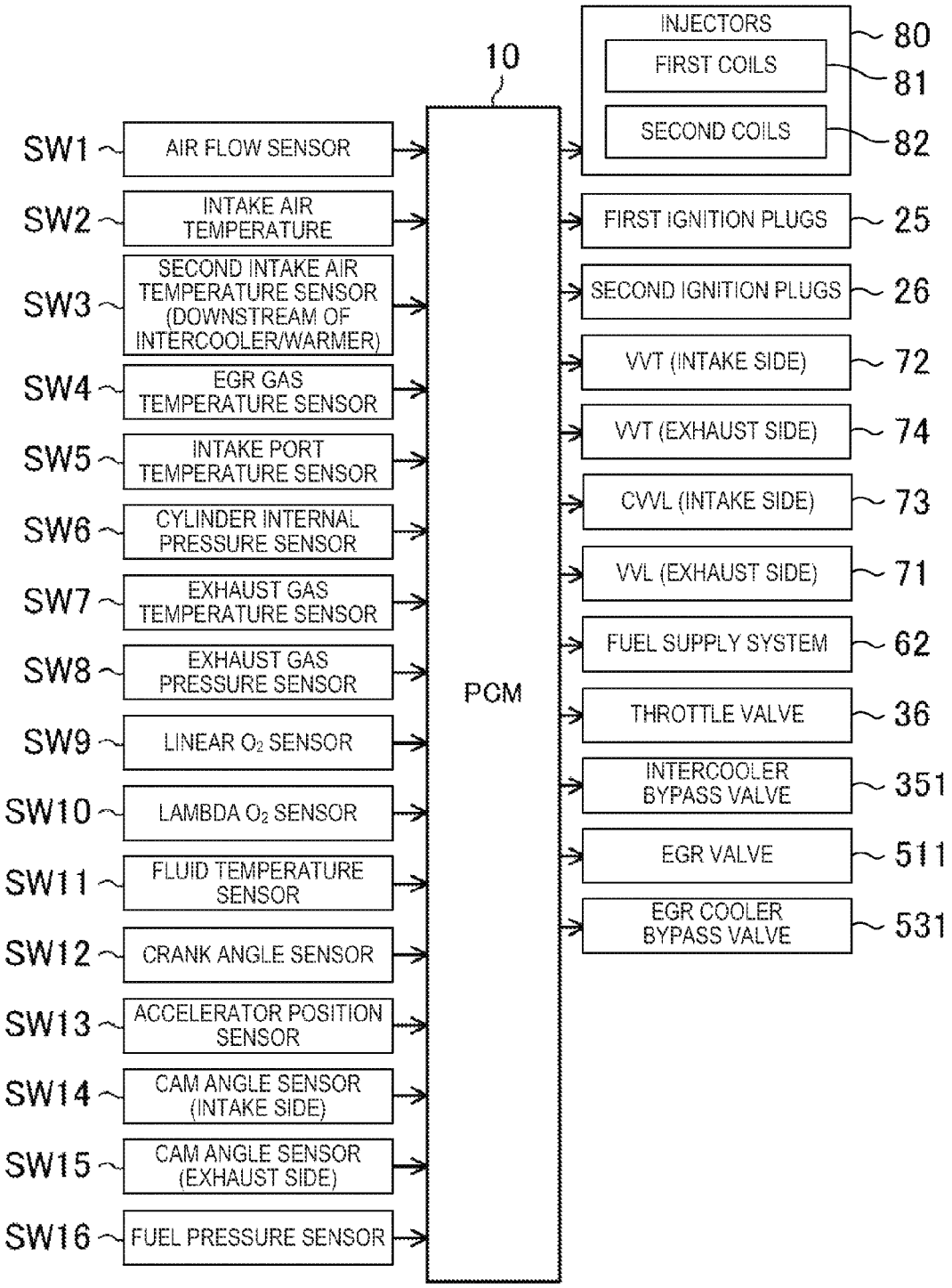
FIG. 2 is a block diagram relating to a control of the spark-ignition direct-injection gasoline engine.

Hereinafter, embodiments of the present invention are described in detail with reference to the appended drawings. The following descriptions of the embodiments are illustrative examples. FIGS. 1 and 2 show a schematic configuration of an engine 1 (engine body) of this embodiment. The engine 1 is a spark-ignition four-cycle engine which is mounted in a vehicle and supplied with fuel at least containing gasoline (specifically, gasoline or mixture fuel of gasoline and alcohol (e.g., E25)). The engine 1 includes a cylinder block 11 provided with a plurality of cylinders 18 (only one cylinder is illustrated), a cylinder head 12 arranged on the cylinder block 11, and an oil pan 13 arranged below the cylinder block 11, where a lubricant is stored. In this embodiment, the engine 1 includes four cylinders 18 arranged in line (not illustrated). Inside the cylinders 18, pistons 14 coupled to a crankshaft 15 via connecting rods 142, respectively, are reciprocatably fitted. A cavity 141 having a reentrant shape, such as the shape formed in diesel engines, is formed on a top face of each piston 14. When the piston 14 is at a position near a compression top dead center (TDC), the cavity 141 faces toward an injector 80 described later.

The cylinder head 12, the cylinders 18, and the pistons 14 each formed with the cavity 141, serve to define the combustion chambers. Note that, the shape of the combustion chamber is not limited to the shape in the illustration. For example, the shape of the cavity 141, a shape of the top face of the piston 14, and a shape of a ceiling part of the combustion chamber may suitably be changed.

A geometric compression ratio of the engine 1 is set comparatively high (15:1 or above) so as to improve a theoretical thermal efficiency and stabilize compression-ignition combustion (described later). Note that, the geometric compression ratio may suitably be set within a range between 15:1 to 20:1.

In the cylinder head 12, for each of the cylinders 18, an intake port 16 and an exhaust port 17 are formed, and an intake valve 21 for opening and closing the opening of the intake port 16 on the combustion chamber side and an exhaust valve 22 for opening and closing the opening of the exhaust port 17 on the combustion chamber 19 side are arranged.

Within a valve system of the engine 1 for operating the intake and exhaust valves 21 and 22, a mechanism such as a hydraulically-actuated variable valve mechanism 71 (see FIG. 2, hereinafter, it may be referred to as the VVL (Variable Valve Lift)) for switching an operation mode of the exhaust valve 22 between a normal mode and a special mode is provided on an exhaust side. The VVL 71 (a detailed configuration is not illustrated) includes two kinds of cams having different cam profiles in which a first cam has one cam nose and a second cam has two cam noses; and a lost motion mechanism for selectively transmitting an operation state of either one of the first and second cams to the exhaust valve 22. When the lost motion mechanism transmits the operation state of the first cam to the exhaust valve 22, the exhaust valve 22 operates in the normal mode where it opens only once during exhaust stroke. On the other hand, when the lost motion mechanism transmits the operation state of the second cam to the exhaust valve 22, the exhaust valve 22 operates in the special mode where it opens once during the exhaust stroke as well as once during the intake stroke, in a so-called exhaust open-twice control. The normal and special modes of the VVL 71 are switched therebetween according to an operating state of the engine. Specifically, the special mode is utilized for a control related to an internal EGR. Note that, an electromagnetically-operated valve system for operating the exhaust valve 22 by using an electromagnetic actuator may be adopted for switching between the normal and special modes.

Further, on the valve system on the exhaust side, a phase variable mechanism 74 (hereinafter, it may be referred as the VVT (Variable Valve Timing)) for changing a rotation phase of an exhaust camshaft with respect to the crankshaft 15 is provided. Any known structure, such as electromagnetic-type or mechanic-type, may suitably be adopted for the VVT 74 (a detailed structure is not illustrated).

While the valve system is provided with the VVL 71 and VVT 74 on the exhaust side, as shown in FIG. 2, the VVT 72 and a lift variable mechanism 73 (hereinafter, it may be referred as the CVVL (Continuously Variable Valve Lift) for continuously changing a lift of the intake valve 21 are provided on an intake side of the valve system. Various kinds of known structures may suitably be adopted for the CVVL 73 (a detailed structure is not illustrated). Opening and closing timings, and the lift of the intake valve 21 can be changed by the VVT 72 and the CVVL 73, respectively.

An injector 80 for directly injecting the fuel into the cylinder 18 is attached to the cylinder head 12, for each cylinder 18. A nozzle hole of the injector 80 is arranged so as to face inside the combustion chamber from a central area of the ceiling surface of the combustion chamber. The injector 80 directly injects the fuel into the combustion chamber by an amount according to the operating state of the engine 1 at an injection timing according to the operating state of the engine 1. In this embodiment, the nozzle of the injector 80 includes a plurality of nozzle holes, in other words, the injector 80 is a multi hole injector. Thereby, the injector 80 injects the fuel so that the atomized fuel spreads radially. The detailed configuration of the injector 80 is described later.

A fuel supply path couples a fuel tank (provided in a position out of the range in the illustration) to each injector 80. A fuel supply system 62 having a high pressure fuel pump 90 and a fuel rail 64, and which is able to supply the fuel to each of the direct injectors 67 with a comparatively high fuel pressure, is provided within the fuel supply path. The high pressure fuel pump 90 pumps the fuel from the fuel tank to the fuel rail 64, and the fuel rail 64 accumulates the pumped fuel with a comparatively high fuel pressure therein. By opening the nozzle holes of the injector 80, the fuel accumulated in the fuel rail 64 is injected from the nozzle holes of the injector 80. The high pressure fuel pump 90 (described in detail later) is a plunger-type pump, and is operated by the engine 1. The fuel supply system 62 is configured to be able to supply of fuel with a high fuel pressure (40 MPa or above), to each injector 80. As described later, the pressure of the fuel to be supplied to the injector 80 is changed according to the operating state of the engine 1. Note that, the fuel supply system 62 is not limited to this configuration.

Further, in the cylinder head 12, ignition plugs 25 and 26 for igniting the air-fuel mixture inside the combustion chamber are provided for each cylinder 18 (see FIG. 2, and note that the illustration of the ignition plugs is omitted in FIG. 1). The engine 1 is provided with two ignition plugs, namely, the first ignition plug 25 and the second ignition plug 26, for each cylinder 18. Each ignition plug 25 is arranged between the two intake valves 21 of each cylinder 18 and each ignition plug 26 is arranged between the two exhaust valves 22 of each cylinder 18, so that the two ignition plugs 25 and 26 oppose each other, and are attached penetrating the cylinder head 12 so as to extend obliquely downward toward the central axis of the cylinder 18. Thus, tip ends of the ignition plugs 25 and 26 are arranged in proximity to a tip end of the injector 80 arranged in the central area of the combustion chamber, to orient toward the combustion chamber.

On one side surface of the engine 1, as shown in FIG. 1, an intake passage 30 is connected to communicate with each of the intake ports 16 of the cylinders 18. On the other side of the engine 1, an exhaust passage 40 for discharging the burned gas (exhaust gas) from each of the combustion chambers of the cylinders 18 is connected.

An air cleaner 31 for filtering intake air is arranged in an upstream end portion of the intake passage 30. A surge tank 33 is arranged near a downstream end of the intake passage 30. A part of the intake passage 30 on the downstream side of the surge tank 33 is branched to independent passages extending toward the respective cylinders 18, and downstream ends of the independent passages are connected with the respective intake ports 16 for each of the cylinders 18.

A water-cooled type intercooler/warmer 34 for cooling or heating air, and a throttle valve 36 for adjusting an intake air amount to each cylinder 18 are arranged within the intake passage 30 between the air cleaner 31 and the surge tank 33. Further, an intercooler bypass passage 35 for bypassing the intercooler/warmer 34 is connected within the intake passage 30, and an intercooler bypass valve 351 for adjusting an air flow rate passing through the passage 35 is arranged within the intercooler bypass passage 35. A ratio of a flow rate through the intercooler bypass passage 35 and a flow rate through the intercooler/warmer 34 is adjusted through adjusting an opening of the intercooler bypass valve 351, and thereby, a temperature of fresh air to be introduced into the cylinder 18 is adjusted.

An upstream portion of the exhaust passage 40 is configured with an exhaust manifold having independent passages branched toward the respective cylinders 18 to connect with outer ends of the exhaust ports 17 and a collecting section where the independent passages are collected therein. In a portion of the exhaust passage 40 on the downstream side of the exhaust manifold, a closely coupled catalyst 41 and an underbody catalyst 42 are connected to serve as an exhaust emission control system for purifying hazardous components contained in the exhaust gas. Each of the closely coupled catalyst 41 and the underbody catalyst 42 includes a cylinder case and, for example, a three-way catalyst arranged in a flow passage within the case.

A portion of the intake passage 30 between the surge tank 33 and the throttle valve 36 is connected with a portion of the exhaust passage 40 on the upstream side of the direct catalyst 41, via an EGR passage 50 for re-circulating a part of the exhaust gas to the intake passage 30. The EGR passage 50 includes a main passage 51 arranged with an EGR cooler 52 for cooling the exhaust gas by an engine coolant, and an EGR cooler bypass passage 53 for bypassing the EGR cooler 52. An EGR valve 511 for adjusting a re-circulation amount of the exhaust gas to the intake passage 30 is arranged within the main passage 51 and an EGR cooler bypass valve 531 for adjusting a flow rate of the exhaust gas flowing through the EGR cooler bypass passage 53 is arranged within the EGR cooler bypass passage 53.

The engine 1 configured as above is controlled by a powertrain control module 10 (hereinafter, it may be referred to as the PCM). The PCM 10 is configured by a CPU, a memory, a counter timer group, an interface, and a microprocessor with a bus for connecting these units. The PCM 10 forms a controller.

As shown in FIGS. 1 and 2, detection signals from various kinds of sensors SW1 to SW16 are inputted to the PCM 10. The various kinds of sensors include sensors as follows: an air flow sensor SW1 for detecting the flow rate of the fresh air and an intake air temperature sensor SW2 for detecting the temperature of the fresh air that are arranged on the downstream side of the air cleaner 31; a second intake air temperature sensor SW3 arranged on the downstream side of the intercooler/warmer 34 and for detecting the temperature of the fresh air after passing through the intercooler/warmer 34; an EGR gas temperature sensor SW4 arranged close to a connecting section of the EGR passage 50 with the intake passage 30 and for detecting the temperature of external EGR gas; an intake port temperature sensor SW5 attached to the intake port 16 and for detecting the temperature of the intake air immediately before flowing into the cylinder 18; a cylinder internal pressure sensor SW6 attached to the cylinder head 12 and for detecting the pressure inside each cylinder 18; an exhaust gas temperature sensor SW7 and an exhaust gas pressure sensor SW8 arranged close to a connecting section of the exhaust passage 40 with the EGR passage 50 and for detecting the exhaust gas temperature and pressure, respectively; a linear $O_2$ sensor SW9 arranged on the upstream side of the direct catalyst 41 and for detecting an oxygen concentration within the exhaust gas; a lambda $O_2$ sensor SW10 arranged between the closely coupled catalyst 41 and the underbody catalyst 42 and for detecting the oxygen concentration within the exhaust gas; a fluid temperature sensor SW11 for detecting a temperature of the engine coolant; a crank angle sensor SW12 for detecting a rotational angle of the crankshaft 15; an accelerator position sensor SW13 for detecting an accelerator opening amount corresponding to an angle of an acceleration pedal (not illustrated) of the vehicle; cam angle sensors SW14 and SW15 on the intake and exhaust sides, respectively; and a fuel pressure sensor SW16 attached to the fuel rail 64 of the fuel supply system 62 and for detecting the fuel pressure to be supplied to the injector 80.

By performing various kinds of operations based on these detection signals, the PCM 10 determines states of the engine 1 and the vehicle, and further outputs control signals to the injectors 80, the first and second ignition plugs 25 and 26, the VVT 72 and CVVL 73 on the intake valve side, the VVL 71 on the exhaust valve side, the VVT 74, the fuel supply system 62, and the actuators of the various kinds of valves (throttle valve 36, intercooler bypass valve 351, the EGR valve 511, and the EGR cooler bypass valve 531) according to the determined states. Thereby, the PCM 10 operates the engine 1.

Figure 3:
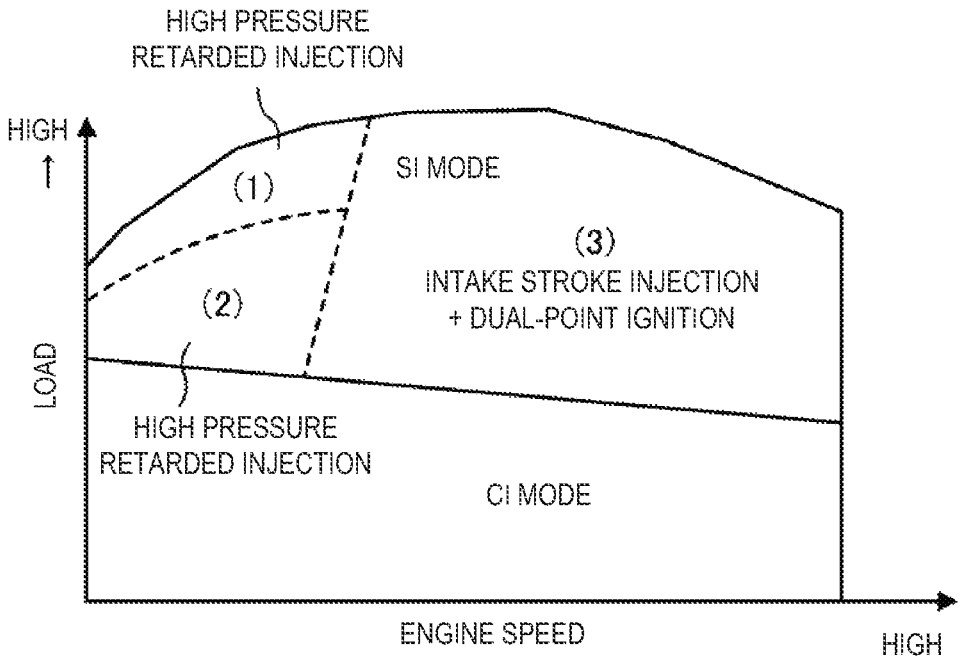
FIG. 3 is a chart illustrating an operating range of the engine.

FIG. 3 shows an example of an operating range of the engine 1. Within a low engine load range where an engine load is relatively low, the engine 1 performs compression-ignition combustion in which combustion is generated by a compression self-ignition without performing ignitions by the ignition plugs 25 and 26, so as to improve fuel consumption and exhaust emission performance. However, with the compression-ignition combustion, the speed of the combustion becomes excessively rapid as the load of the engine 1 increases, and thereby, causes a problem of, for example, combustion noise. Therefore, with the engine 1, within a high engine load range where the engine load is relatively high, the compression-ignition combustion is stopped and is switched to spark-ignition combustion using the ignition plugs 25 and 26. Thus, the engine 1 is configured to switch a mode between a CI (Compression-Ignition) mode where the compression-ignition combustion is performed and an SI (Spark Ignition) mode where the spark-ignition combustion is performed, according to the operating state of the engine 1 and, especially, the load of the engine 1. A boundary line for switching the combustion mode is not limited to the line in the illustration.

In the CI mode, basically, the injector 80 injects the fuel inside the cylinder 18 at a comparatively early timing, for example, during either one of intake stroke and compression stroke, and thereby, comparatively homogeneous lean air-fuel mixture gas is formed (air excess ratio $\lambda \geq 1$, e.g., $\lambda \geq 2.5$), and further the air-fuel mixture gas is compressed to self-ignite near a compression top dead center. Note that, the fuel injection amount is set according to the load of the engine 1.

Further, in the CI mode, the exhaust open-twice control in which the exhaust valve 22 is also opened during intake stroke is performed by the control of the VVL 71, and thus, the internal EGR gas is introduced into the cylinder 18. The introduction of the internal EGR gas increases a temperature inside the cylinder at the end of compression stroke and stabilizes the compression-ignition combustion.

Since the temperature inside the cylinder 18 (in-cylinder temperature) naturally increases due to the increase of the engine load, in view of avoiding the pre-ignition, the internal EGR amount is reduced. For example, the internal EGR amount may be adjusted by the control of the CVVL 73 to adjust the lift of the intake valve 21. Alternatively, the internal EGR amount may be adjusted by controlling the opening of the throttle valve 36.

When the engine load is further increased, within the operating range shown in FIG. 3, near the boundary line between the CI mode and the SI mode, the in-cylinder temperature may excessively increase, thereby causing difficulty in controlling the compression-ignition. Therefore, within a part of the operating range in the CI mode where the engine load is high, the rate of the internal EGR gas to be introduced into the cylinder 18 is reduced, and instead, the opening of the EGR valve 511 is increased so as to introduce a larger amount of external EGR gas cooled by the EGR cooler 52 into the cylinder 18. In this manner, the in-cylinder temperature can be suppressed to be low, and the compression-ignition becomes controllable.

Meanwhile, in the SI mode (described later in detail), basically, the injector 80 injects the fuel inside the cylinder 18 between intake stroke and an early stage of expansion stroke, and thereby, homogenized or stratified lean air-fuel mixture gas is formed, and further, an ignition is performed near the compression TDC to ignite the air-fuel mixture gas. Moreover, in the SI mode, the engine 1 is operated with a theoretical air-fuel ratio ($\lambda=1$). Thereby, the three-way catalyst can be used, and this becomes advantageous in improving the emission performance.

In the SI mode, the opening of the EGR valve 511 is adjusted while the throttle valve 36 is fully opened, so as to adjust the fresh air amount and the external EGR gas amount to be introduced into the cylinder 18, and as a result, a fill amount is adjusted. This is also effective in reducing a pumping loss and cooling loss. Additionally, the introduction of the cooled external EGR gas contributes in avoiding the abnormal combustion, and also has an advantage of suppressing the generation of Raw NOx. Note that, within a full-engine-load range, the external EGR is stopped by closing the EGR valve 511.

As described above, the geometric compression ratio of the engine 1 is set to be 15:1 or above (e.g., 18:1). Because a high compression ratio increases the temperature and pressure at the end of compression stroke, it is advantageous in stabilizing the compression-ignition combustion in the CI mode. On the other hand, because the high compression ratio engine 1 switches the combustion mode to the SI mode within the high engine load range, there is an inconvenience that abnormal combustion such as a pre-ignition and knocking easily occurs as the engine load increases.

Thus, with the engine 1, when the operating state of the engine is within a low-engine-speed range within the high-engine-load range including a maximum engine load (see the parts (1) and (2) in FIG. 3, and note that the phrase "low-engine-speed range" used herein corresponds to a low-engine-speed range formed by dividing the operating range of the engine 1 into three ranges: high-engine-speed range, middle-engine-speed range, and low-engine-speed range), by performing the SI combustion in which an injection mode of the fuel is greatly differed from the conventional mode, the abnormal combustion is avoided. Specifically, in the injection mode of the fuel of this embodiment, within a period between a late stage of compression stroke and the early stage of expansion stroke, that is a period significantly retarded compared to the conventional mode (hereinafter, the period is referred to as the retarded period), the fuel injection to the cylinder 18 is performed by the injector 80 with a fuel pressure greatly increased compared to the conventional mode (see FIG. 4A). Hereinafter, this characteristic fuel injection mode is referred to as "the high pressure retarded injection" or simply "the retarded injection." The high pressure retarded injection shortens the respective fuel injection period, mixture gas forming period, and combustion period so as to shorten a reactive time length of unburnt mixture gas from the start of the fuel injection until the combustion complete. As a result, within a range where the engine load is high and the engine speed is low, and the abnormal combustion easily occurs, the abnormal combustion can be avoided. The fuel pressure is required to be set to 40 MPa or above. Specifically, when the injection is performed with the high fuel pressure of 40 MPa or above, turbulence energy caused thereby is high and rapid combustion occurs, resulting in shortening the combustion period. Abnormal combustion is avoided by fuel injection with such characteristics. The fuel pressure may suitably be set depending on the property of the used fuel containing gasoline, and the maximum value may be about 120 MPa.

Figure 4A:
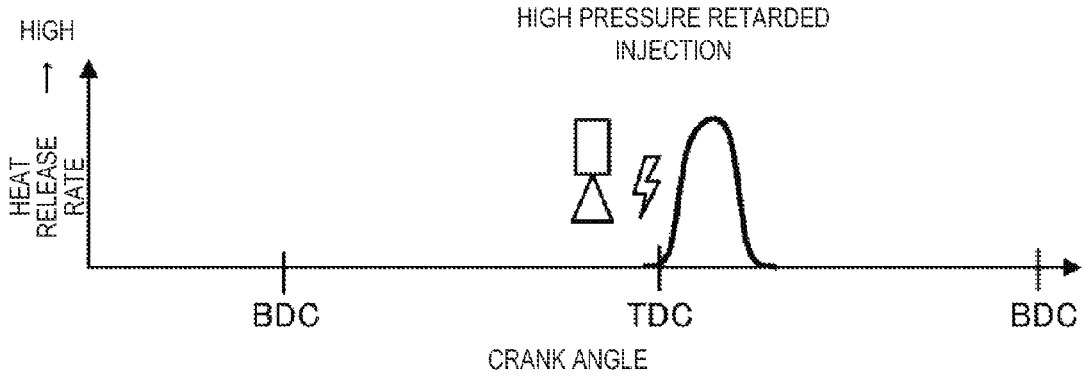
FIG. 4A is a chart illustrating a fuel injection timing and an ignition timing in a retard injection, and a heat release rate achieved thereby.

Since the high pressure retarded injection avoids the abnormal combustion by devising the fuel injection mode, the ignition timing can be advanced. As shown in FIG. 4A, the ignition timing is set to near the compression TDC, and the ignition is performed by operating either one of the first ignition plug 25 or the second ignition plug 26. The advance of the ignition timing is advantageous in increasing a thermal efficiency and a torque. Note that, the injection timing and the ignition timing shown in FIG. 4A are merely illustration, and not limited to this.

Within the operating range where the high pressure retarded injection is performed, within the range with lower engine load (see the part (2) in FIG. 3) than the maximum engine load range (see the part (1) in FIG. 3), since the generation of the abnormal combustion is suppressed compared to the range (1), the upper limit of the fuel pressure (e.g., about 80 MPa) may be lowered and the fuel injection timing may be advanced within the range in the later stage of compression stroke.

Note that, within the range of the operating range in the CI mode where the engine load is high and, thus, it likely becomes difficult to control the compression-ignition, the high pressure retarded injection may be performed as the operating range in the SI mode with the high engine load (see the part (2) in FIG. 3), in addition to reducing the introduction rate of the internal EGR gas as described above. In this manner, a rapid rise of the fuel pressure in the CI mode is suppressed, and the increase in engine noise can be suppressed.

Figure 4B:
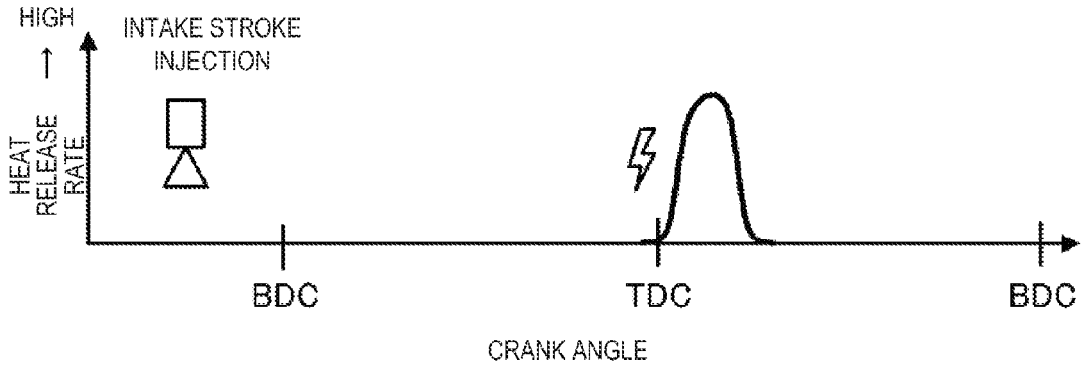
FIG. 4B is a chart illustrating a fuel injection timing and an ignition timing in an intake stroke injection, and a heat release rate achieved thereby.

On the other hand, when the operating state of the engine is within a high-engine-speed range within the high-engine-load range (see the part (3) in FIG. 3, and note that, the phrase "high-engine-speed range" used herein corresponds to a high-engine-speed range formed by dividing the operating range of the engine 1 into three ranges: high-engine-speed range, middle-engine-speed range, and low-engine-speed range), as shown in FIG. 4B, the fuel is injected within an intake stroke period in which the intake valve 21 is open, and not within the retarded period. Hereinafter, this fuel injection mode is referred to as "the intake stroke injection." In the intake stroke injection, since a high fuel pressure is not required the fuel pressure is reduced to be lower than in the high pressure retarded injection (e.g., below 40 MPa). In this manner, the mechanical resistance loss of the engine 1 due to the operation of the high pressure fuel pump 90 is reduced, and it becomes advantageous in improving the fuel consumption.

Although the high pressure retarded injection shortens the reactable time length of the unburnt mixture gas by injecting the fuel within the retarded period, the shortening of the reactable time length is not effective within the high-engine-speed range where the engine speed is comparatively high because an actual time length required for the change of the crank angle is short, while the shortening is effective within the low-engine-speed range where the engine speed is comparatively low because the actual time length required for the change of the crank angle is long. In contrast, in the retarded injection, since the fuel injection timing is set to near the compression TDC, air without fuel, in other words, air with a high specific heat ratio is compressed on compression stroke. As a result, within the high-engine-speed range, the temperature inside the cylinder 18 at the compression TDC (i.e., compression end temperature) becomes high, causing knocking due to the high compression end temperature. Therefore, when the retarded injection is performed during the high speed operation, the ignition timing needs to be retarded to avoid knocking.

Thus, with the engine 1 of this embodiment, within the range (3) (i.e., high-engine-load and high-engine-speed range), the intake stroke injection is performed instead of the retarded injection.

In the intake stroke injection, the specific heat ratio of the in-cylinder gas during compression stroke (i.e., mixture gas containing the fuel) can be reduced, and accordingly, the compression end temperature can be suppressed to be low. Since knocking can be suppressed by lowering the compression end temperature, the ignition timing can be advanced. Thus, within the range (3), the ignition is performed near the compression TDC similarly to the high pressure retarded injection. However, within the range (3), in view of shortening the combustion period, the ignition is a dual-point ignition in which the first and second ignition plugs 25 and 26 are both operated. The first and second ignition plugs 25 and 26 may ignite simultaneously or with a time difference therebetween.

Therefore, with this engine 1, within the high-engine-load and low-engine-speed range (the ranges (1) and (2) shown in FIG. 3), the thermal efficiency is improved while avoiding the abnormal combustion by performing the high pressure retarded injection.

Moreover, with this engine, within the high-engine-load and high-engine-speed range (the range (3) shown in FIG. 3), by performing the intake stroke injection, the thermal efficiency is improved while avoiding the abnormal combustion by performing the high pressure retarded injection. Additionally, within the high-engine-load and high-engine-speed range, by performing the dual-point ignition, the flame spreads from a plurality of fire origins within the combustion chamber respectively, and therefore, the flame spreads quickly and the combustion period becomes shorter. With the dual-point ignition, even when the ignition timing is retarded to after the compression TDC, the center of gravity of the combustion is positioned on the advance side as much as possible, the dual-point ignition becomes advantageous in improving the thermal efficiency and increasing the torque, and as a result, improving the fuel consumption. Note that, the number of the ignition plugs is not limited to two, and it may be three or more, or only one. A multi-point ignition may be performed in the high pressure retarded injection. The high pressure retarded injection may be switched to divided injections as needed, and similarly, the intake stroke injection may also be switched to divided injections as needed. As a result, the injection is performed at least once on intake stroke, as well as the fuel injection may also be performed on compression stroke.

(Basic Configuration of Injector)

Figure 5:
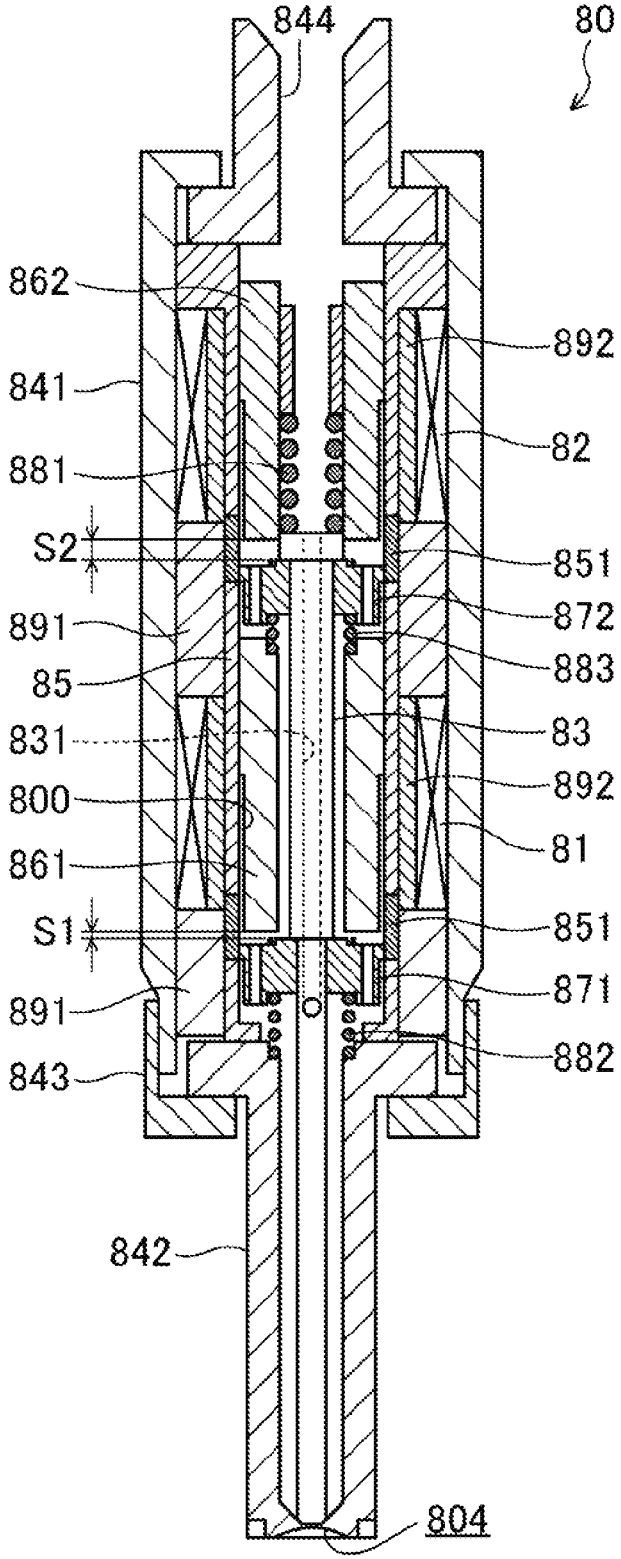
FIG. 5 is a cross-sectional view showing a configuration of an injector.
Figure 6:
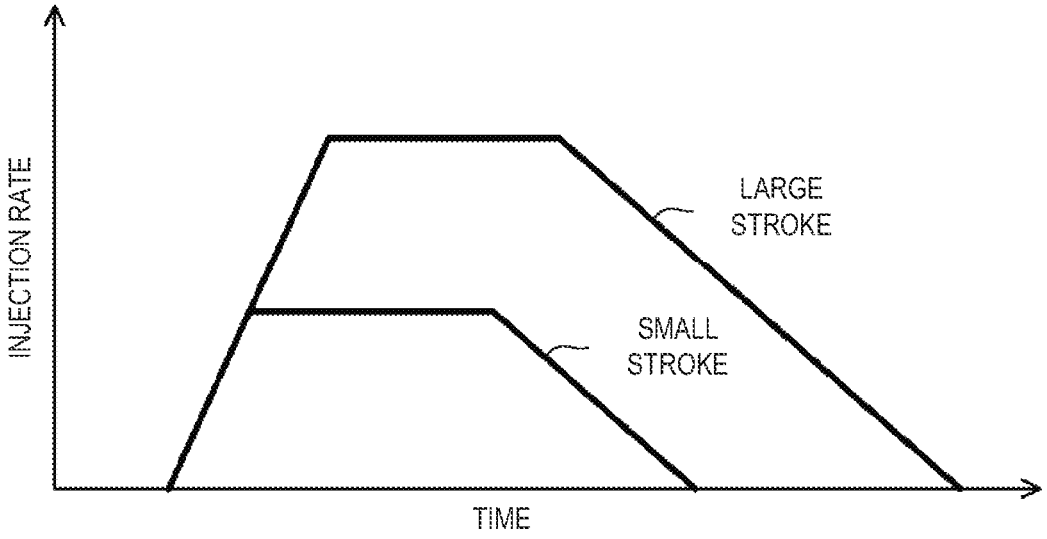
FIG. 6 is a chart comparing a property between a large stroke and a small stroke of the injector.

FIG. 5 shows a configuration of the injector 80. The injector 80 is configured to be a solenoid-operated injector for opening a plurality of nozzle holes 84 (see also FIG. 11) formed in a tip face 804, by directly attracting a needle 83 arranged within its fuel passage so as to stroke by a magnetic circuit formed by supplying power to a solenoid coil. The injector 80 has two solenoid coils: a first solenoid coil 81 and a second solenoid coil 82, and can switch the stroke amount of the needle 83 between a first stroke amount S1 which is relatively small, and a second stroke amount S2 which is relatively large. In this manner, as illustrated in FIG. 6, the injector 80 can secure a high fuel injection accuracy from a small injection amount to a large injection amount. Such an injector 80 is suitable for the engine 1 where a high fuel injection accuracy is required over a wide range from the small injection amount for the compression-ignition combustion performed when the operating state of the engine 1 is within the low-engine-load range, to the large injection amount for when the operating state of the engine 1 is within the high-engine-load range. Especially, since the fuel containing gasoline is used and influence of a variation in fuel injection amount on degradation of the exhaust emission performance and also the combustion stability is highly sensitive, a particularly high fuel injection accuracy is required with the engine 1.

The body of the injector 80 is configured by coupling, using a coupling member 843, a first cylindrical valve body 841 having a large diameter to a second cylindrical valve body 842 extending from one end of the first valve body 841 and having a small diameter with its tip end closed.

Within the first valve body 841, a cylindrical case 85 is accommodated, and a fuel passage 800 is formed by an inner circumferential surface of the case 85. An upper end of the case 85 opens at a base end (upper end in FIG. 5) of the injector 80, and a lower end of the case 85 opens to communicate with a base end opening of the second valve body 842. Accordingly, the fuel passage 800 is formed inside the injector 80, which supplies the fuel from the fuel inlet port 844 communicating with the fuel rail 64 at the base end of the injector 80, to each nozzle hole 84 opening at the tip end of the injector 80.

As described later, the cylindrical case 85 is basically configured by a magnetic body so as to constitute a part of the magnetic circuit during the power supply to the first and second solenoid coils 81 and 82. Specifically, the case 85 is formed by ferritic metal (e.g., ferrite steel).

The needle 83 for opening and closing each nozzle hole 84 is arranged within the case 85 to be coaxial to the case 85. The needle 83 extends toward the tip end of the injector 80 from near a central area of the case 85 in an axial direction of the injector 80, and a tip portion of the needle 83 is positioned in a tip portion of the second valve body 842. In the needle 83, a hole 831 opening to a base end face of the needle 83 and extending toward the tip portion of the needle 83 is formed to extend along a central axis of the needle 83. The hole 831 opens to a circumferential surface of the needle 83 near a central area of the needle 83 in the axial direction. The hole 831 functions as a part of the fuel passage connecting the upper side of a second movable core 872 and the lower side of a second movable core 871.

The first and second solenoid coils 81 and 82 are arranged between the first valve body 841 and the case 85 so that the first solenoid coil 81 is on the lower side and the second solenoid coil 82 is on the upper side with respect to each other while having a predetermined gap therebetween in the axial direction of the injector 80.

Within the case 85, a cylindrical first fixed core 861 is fixed at a position opposing to the first solenoid coil 81 via the case 85, and similarly, a cylindrical second fixed core 862 is fixed at a position opposing to the second solenoid coil 82 via the case 85. The first and second fixed cores 861 and 862 include magnetic bodies so as to constitute a part of the magnetic circuit individually during the power supply to the first and second solenoid coils 81 and 82, respectively.

The ring-shaped first movable core 871 is arranged below the first fixed core 861 with a predetermined gap S1 from a lower end face of the first fixed core 861 in a state of being fitted onto the needle 83. Further, the ring-shaped second movable core 872 is arranged below the second fixed core 862 with a predetermined gap S2 from a lower end face of the second fixed core 862 in a state of being fitted onto the needle 83. The gaps S1 and S2 are set to satisfy S1<S2.

The first movable core 871 fitted onto the needle 83 is engaged with a stepped section formed in a central portion of the needle 83, and similarly, the second movable core 872 fitted onto the needle 83 is engaged with a stepped section formed in an upper end portion of the needle 83. The first and second movable cores 871 and 872 are arranged in the case 85 to be reciprocatable in the axial direction, and when the first movable core 871 moves upward, the needle 83 moves upward due to the engagement between the first movable core 871 and the step section. Moreover, also when the second movable core 872 moves upward, the needle 83 moves upward due to the engagement between the second movable core 872 and the step section. Therefore, the selective movement of the first and second movable cores 871 and 872 can stroke the needle 83.

The needle 83 is biased downwardly by a spring 881 arranged on the base end side of the needle 83 so that each nozzle hole 84 is closed normally. On the other hand, the first and second movable cores 871 and 872 are biased upwardly by springs 882 and 883, respectively, so that the state where the first and second movable cores 871 and 872 are engaged with the respective step sections of the needle 83 is maintained normally.

Figure 7:
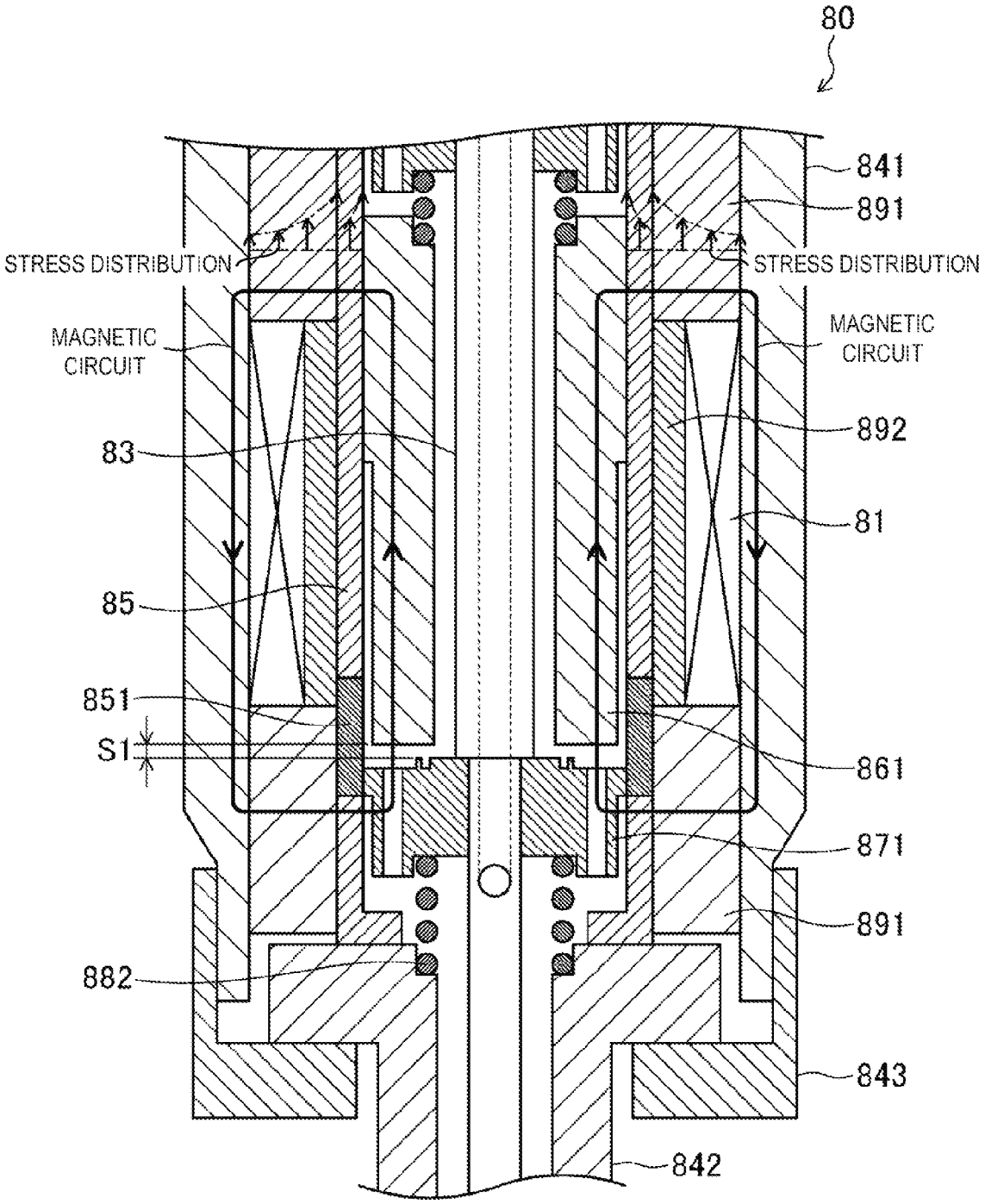
FIG. 7 is an enlarged cross-sectional view showing a structure of the injector near a first solenoid coil.

The first and second movable cores 871 and 872 respectively include magnetic bodies, and as shown in FIG. 7 in an enlarged manner, when the power is supplied to the first solenoid coil 81, the magnetic circuit (see the thick solid arrow line in FIG. 7) passing through the first valve body 841, the case 85, the first movable core 871, and the first fixed core 861 (and first kind reinforcing members 891 described later) is formed, and thereby, the first movable core 871 reciprocatable in the axial direction within the case 85 is attracted upward. In correspondence to the attraction of the first movable core 871, the needle 83 engaged with the first movable core 871 at the step section also moves upward against the biasing force of the spring 881 (and a back pressure acting on the needle 83 due to the fuel pressure, as described later). The first movable core 871 and the needle 83 move upward until the first movable core 871 contacts with the first fixed core 861. In other words, the needle 83 strokes by a first stroke amount S1 corresponding to the gap S1.

Similarly, when the power is supplied to the second solenoid coil 82, the magnetic circuit passing through the first valve body 841, the case 85, the second movable core 872, and the second fixed core 862 (and first kind reinforcing members 891 described later) is formed, and thereby, the second movable core 872 reciprocatable in the axial direction within the case 85 is attracted upward. In correspondence to the attraction of the second movable core 872, the needle 83 engaged with the second movable core 872 at the step section also moves upward against the biasing force of the spring 881 (and the back pressure acting on the needle 83, as described later). Thus, each of the second movable core 872 and the needle 83 strokes by a second stroke amount S2 corresponding to the gap S2, which is until the second movable core 872 contacts with the second fixed core 862.

Here, in the case 85, non-magnetic body parts 851 for preventing shortcut of the magnetic circuit intervene at a position corresponding to a portion between the first fixed core 861 and the first movable core 871 and a position corresponding to a portion between the second fixed core 862 and the second movable core 872, the total of two positions, respectively. Such non-magnetic body parts 851 may be provided to, by friction-joining, upon dividing the case into a plurality of parts, to intermediate portions of the cylindrical case 85 extending in the axial direction, respectively. The friction joint can firmly couple the case 85 to the non-magnetic body portion 851 without thinning the case 85 and the non-magnetic body parts 851, and the friction joint is, as described later, advantageous in increasing the strength of the case 85 which receives an internal pressure caused by a high fuel pressure.

(Reinforcing Structure Enabling to Obtain High Fuel Pressure of Injector)

As described above, the fuel pressure may be set to a high fuel pressure within a range between 40 MPa and about 120 MPa at maximum for example, and thus the internal pressure of the case 85 increases. To withstand the high internal pressure, the thickness of the case 85 needs to be thickened. However, since the case 85 constitutes the part of the magnetic circuit, it is made of, for example, ferritic metal as described above, in other word, it is comparatively weak in strength. Therefore, when the case 85 is to withstand the high internal pressure by itself, the thickness becomes significantly thicker. With such a thick case 85, the magnetic circuit formed over the inside and outside of the case 85 cannot be configured.

Therefore, with this injector 80, reinforcing members are fitted onto the case 85 so that the case 85 forming the fuel passage 800 has a substantially dual tube structure. Specifically, as the reinforcing members, the injector 80 is provided with first kind reinforcing members 891 having a cylindrical shape and arranged adjacent to the respective first and second solenoid coils 81 and 82 in the axial direction, and second kind reinforcing members 892 having a cylindrical shape and provided between the first solenoid coil 81 and the case 85, and between the second solenoid coil 82 and the case 85, respectively.

In the injector 80 in the illustration, the first kind reinforcing members 891 are arranged between the first valve body 841 and the case 85, at a position between the first and second solenoid coils 81 and 82, and a position below the solenoid coil 81, respectively. As shown in FIG. 7 in an enlarged manner, the first kind reinforcing member 891 adjacent to the first solenoid coil 81 or the second solenoid coil 82 in the axial direction includes a magnetic body so as to constitute a part of the magnetic circuit during the power supply to the solenoid coils. In view of improving efficiency of the magnetic circuits, each magnetic body configuring the first kind reinforcing member 891 may be made of ferritic metal (e.g., ferrite steel), similarly to the case 85. The first kind reinforcing member 891 is fitted externally onto the case 85, and thereby, a load acts on the case 85 inwardly from outside in a radial direction thereof. The load acts against the internal pressure on an inner circumferential face of the case 85 caused by the fuel pressure acting outward from inside in the radial direction. The first kind reinforcing member 891 may be fitted externally onto the case 85, by adopting a suitable method, such as press-fitting or shrinkage-fitting.

In this manner, the second kind reinforcing members 892 intervene, as described above, between the first solenoid coil 81 and the case 85, and also between the second solenoid coil 82 and the case 85, respectively. A length of each of the second kind reinforcing members 892 in the axial direction corresponds to each of lengths of the first and second solenoid coils 81 and 82. Unlike the first kind reinforcing member 891, each second kind reinforcing member 892 includes a non-magnetic body to prevent shortcut of the magnetic circuit during the power supply to one of the first and second solenoid coils 81 and 82. The non-magnetic body may be configured by austenite steel, etc. Similarly to the first kind reinforcing member 891, the second kind reinforcing member 892 is also fitted externally onto the case 85, and thereby a load acting inwardly from outside in the radial direction, which is against the internal pressure, acts on the case 85. The second kind reinforcing member 892 may be fitted externally onto the case 85, also by adopting a suitable method, such as press-fitting or shrinkage-fitting.

As described above, by fitting the first and second kind reinforcing members 891 and 892 externally onto the case 85, an opposing force acting inward from outside in the radial direction acts on the case 85 where a high internal pressure acts therein due to the high fuel pressure caused inside the fuel passage 800. As shown in FIG. 7, the dual tube structure with the case and the reinforcing member can disperse a stress to the two inward and outward tubes. As a result, a required strength can be secured without thickening the case 85. This becomes advantageous in forming the magnetic circuit over the inside and outside of the case 85.

Moreover, each first kind reinforcing member 891 is arranged adjacent to either one of the first and second solenoid coils 81 and 82 in the axial direction, and includes the magnetic body constituting the part of the magnetic circuit, and thus, it contributes in both increasing the fuel pressure by reinforcing the case 85, and forming the magnetic circuit. The construction of the first kind reinforcing member 891 with ferrite steel having high magnetic permeability and low residual magnetism is advantageous in improving the performance of the injector 80.

In this manner, each second kind reinforcing member 892 intervenes between the first solenoid coil 81 and the case 85 and between the second solenoid coil 82 and the case 85, and includes the non-magnetic body, and thus, it prevents shortcut of the magnetic circuit, and contributes in both increasing the fuel pressure by reinforcing the case 85, and forming the magnetic circuit. The construction of the second kind reinforcing member 892 with austenite steel can thin the second kind reinforcing member 892 by the strength of the austenite steel and narrow the gaps of the first and second solenoid coils 81 and 82 with the case 85, and thus, is advantageous in forming a magnetic circuit with high efficiency, as well as minimizing the injector 80. Note that, for austenite steel, for example, with reference to JIS, SUS301 and SUS301L (containing 16 to 18% Cr by weight and 6 to 8% Ni by weight), SUS304 (containing 18 to 20% Cr by weight and 8 to 10.5% Ni by weight), or SUS316 (containing 16 to 18% Cr by weight, 10 to 14% Ni by weight, and 2 to 3% Mo by weight) can be used. These materials have mechanical properties in which tension strength is 53 kg/mm$^2$ or higher, and bearing force is 21 kg/mm$^2$ or higher.

(Supporting Structures of First and Second Movable Cores)

Figure 8A:
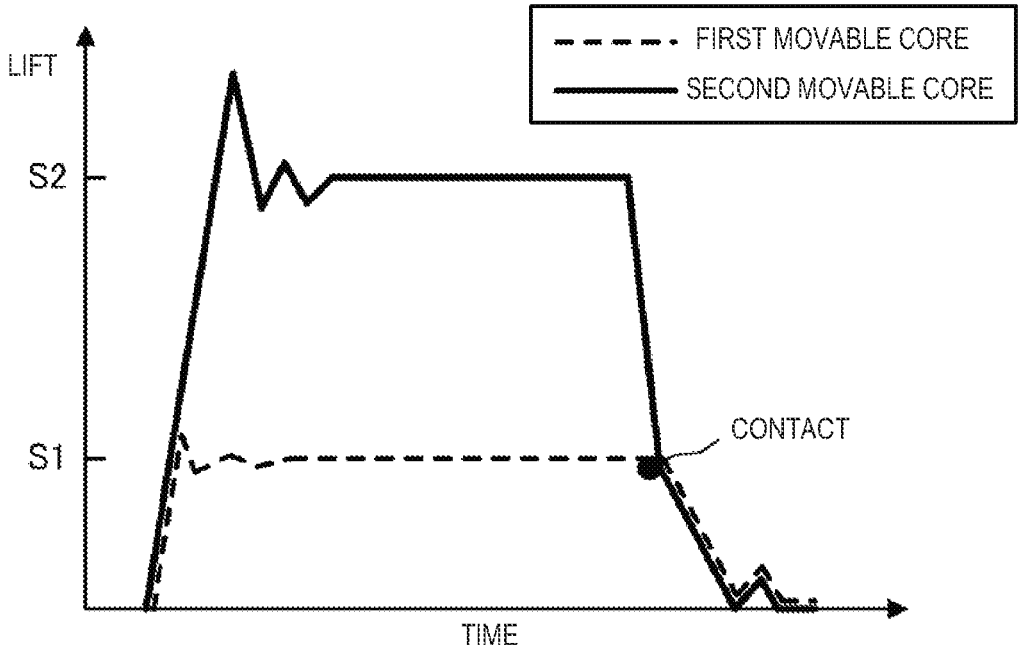
FIG. 8A is a chart showing a lift state of a movable core of the injector shown in FIG. 5 when power is supplied only to the first solenoid coil.

Here, in the injector 80 shown in FIG. 5, springs 882 and 883 are arranged below the first and second movable cores 871 and 872, respectively, so as to bias the first and second movable cores 871 and 872 upwardly. With such a supporting configuration, when the power is supplied to the second solenoid coil 82, as indicated by the solid line in FIG. 8A, the second movable core 872 moves by the predetermined stroke amount S2 and accordingly the needle 83 strokes upwardly. Since the engagement between the first movable core 871 and the step section of the needle 83 is released by the upward stroke, as indicated by the broken line in FIG. 8A, the first movable core 871 moves upwardly by the biasing force of the spring 882.

Then, when the power supply to the second solenoid coil 82 ends, and while the second movable core 872 and the needle 83 descend together according to a difference between the downward biasing force of the spring 881 and the upward biasing force of the spring 883, the step section of the needle 83 is again engaged with the first movable core 871 (see the point with "CONTACT" in FIG. 8A), and then the upward biasing force of the spring 882 is added. The first and second movable cores 871 and 872, and the needle 83 descend integrally according to the difference between the downward biasing force of the spring 881 and the upward biasing force of the springs 882 and 883. In other words, the descending speed of the needle 83 decelerates while descending, and an impact of the tip end of the needle 83 when seated on a seat portion 801 (described later) subsides. This is advantageous in suppressing the sound of impact.

Figure 8B:
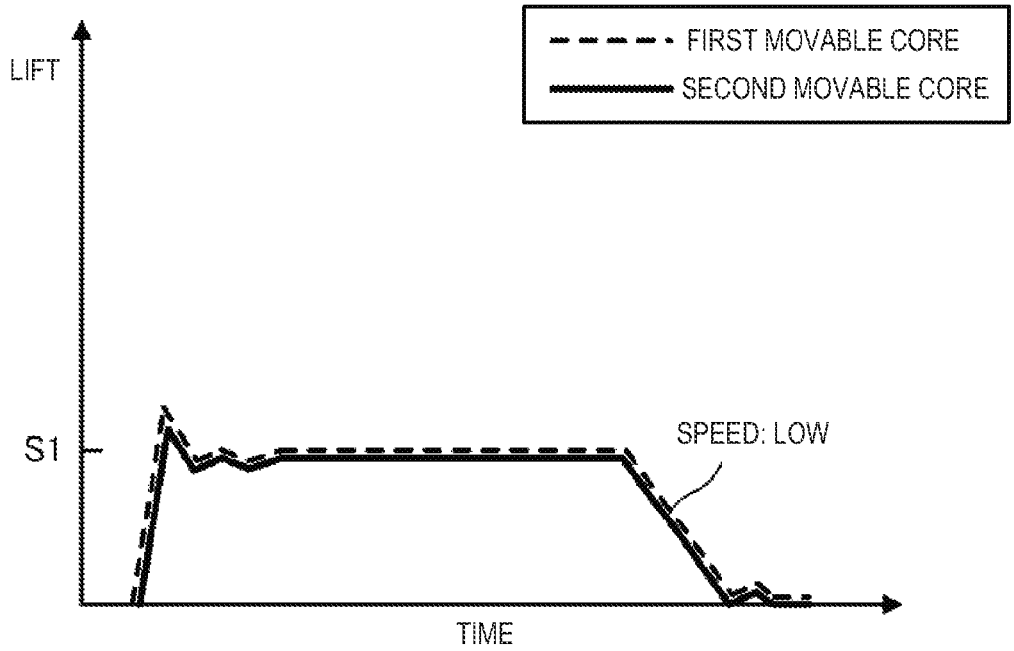
FIG. 8B is a chart showing a lift state of a movable core of the injector shown in FIG. 5 when the power is supplied only to a second solenoid coil.

On the other hand, when the power is supplied to the first solenoid coil 81, as indicated by the broken line in FIG. 8B, the first movable core 871 moves, and accordingly, as indicated by the solid line in FIG. 8B, the needle 83 and the second movable core 872 respectively stroke upwardly by the predetermined stroke amount S1.

Further, when the power supply to the first solenoid coil 81 ends, the first and second movable cores 871 and 872, and the needle 83 descend integrally according to the difference between the downward biasing force of the spring 881 and the upward biasing forces of the springs 882 and 883, and also in this case, the descending speed of the needle 83 decelerates. Therefore, similar to the above case, the impact of the tip end of the needle 83 when seated on the seat portion 801 subsides, becoming advantageous in suppressing the sound of impact.

Figure 9:
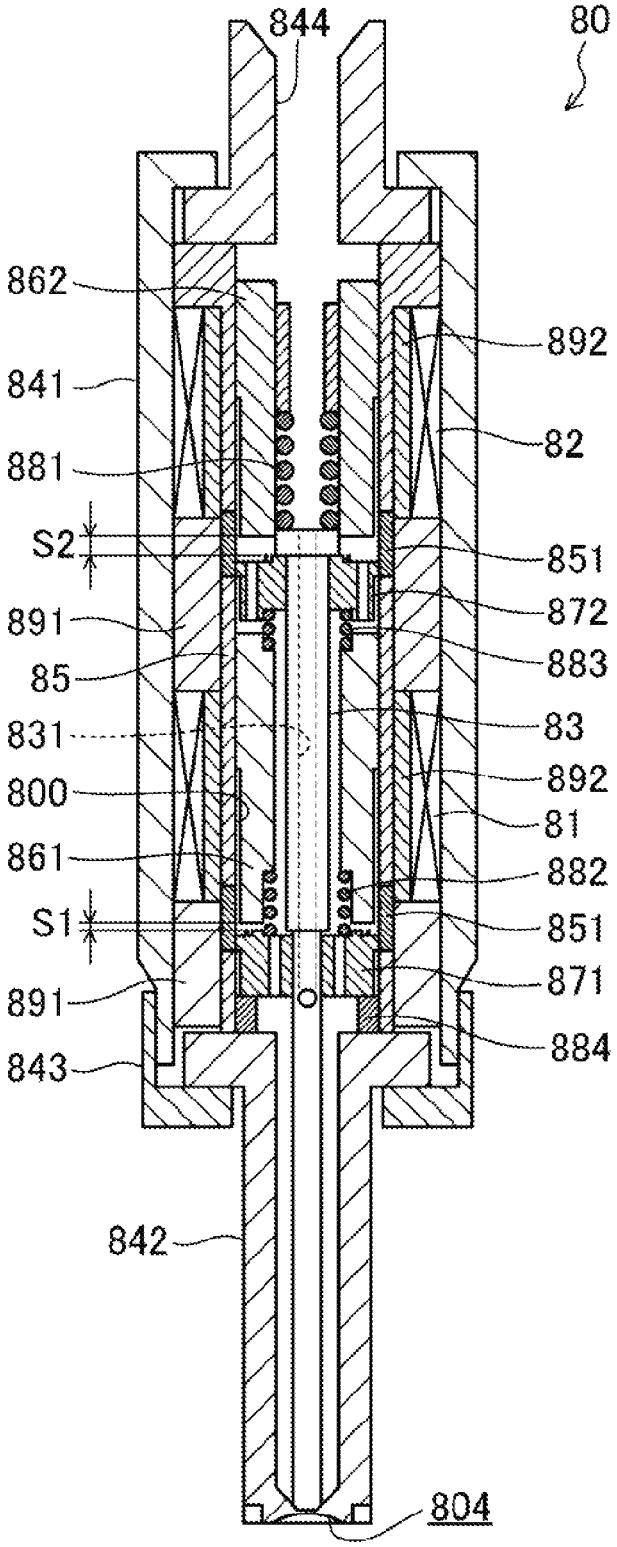
FIG. 9 is a cross-sectional view showing an injector having a different configuration to FIG. 5.

FIG. 9 is a view showing a modification of the injector 80 having a configuration in which the downward biasing force is applied to the first movable core 871 by arranging the spring 882 on the first movable core 871. Note that, in FIG. 9, the same components as the injector 80 shown in FIG. 5 are denoted with the same reference numerals. In the injector 80 shown in FIG. 9, a spacer 884 is arranged below the first movable core 871 to define the gap S1 between the first movable core 871 and the first fixed core 861.

Figure 10A:
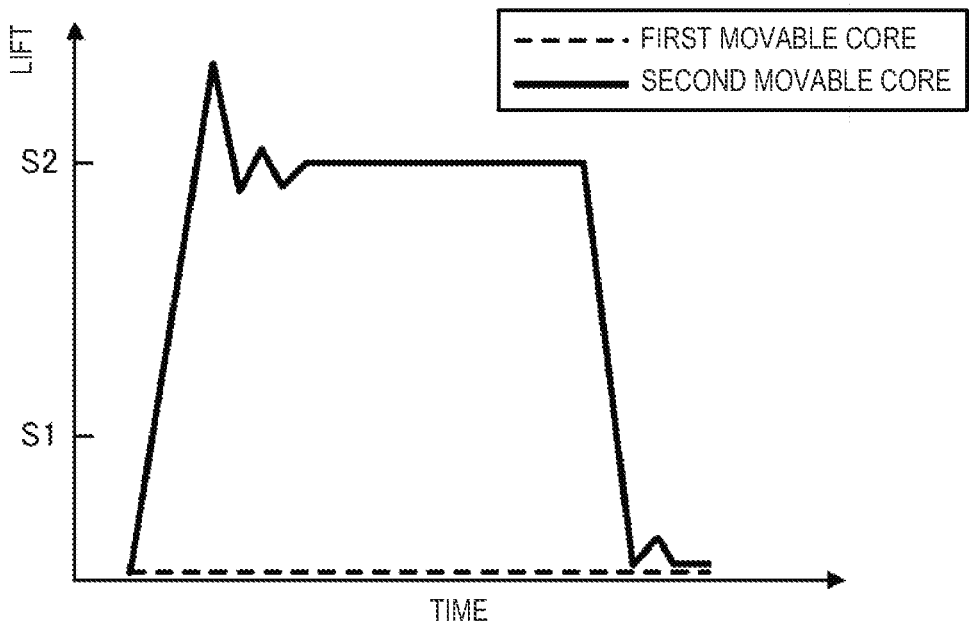
FIG. 10A is a chart showing a lift state of a movable core of the injector shown in FIG. 9 when power is supplied only to the first solenoid coil.

In the injector 80 shown in FIG. 9, when the power is supplied to the second solenoid coil 82, as indicated by the solid line in FIG. 10A, the second movable core 872 and the needle 83 move upwardly only by the predetermined stroke amount S2 similar to the above embodiment; however, since the first movable core 871 is biased downwardly, as indicated by the broken line in FIG. 10A, it remains stopped as indicated by the broken line in FIG. 10A.

When the power supply to the second solenoid coil 82 ends, the second movable core 872 and the needle 83 descend together according to the difference between the downward biasing force of the spring 881 and the upward biasing force of the spring 883. As described above, here, since the first movable core 871 does not move upwardly, unlike to the embodiment shown FIG. 8A, the first movable core 871 does not engage with the step section of the needle 83 while descending. As a result, the needle 83 seats on the seat portion 801 without changing its descending speed while descending.

Figure 10B:
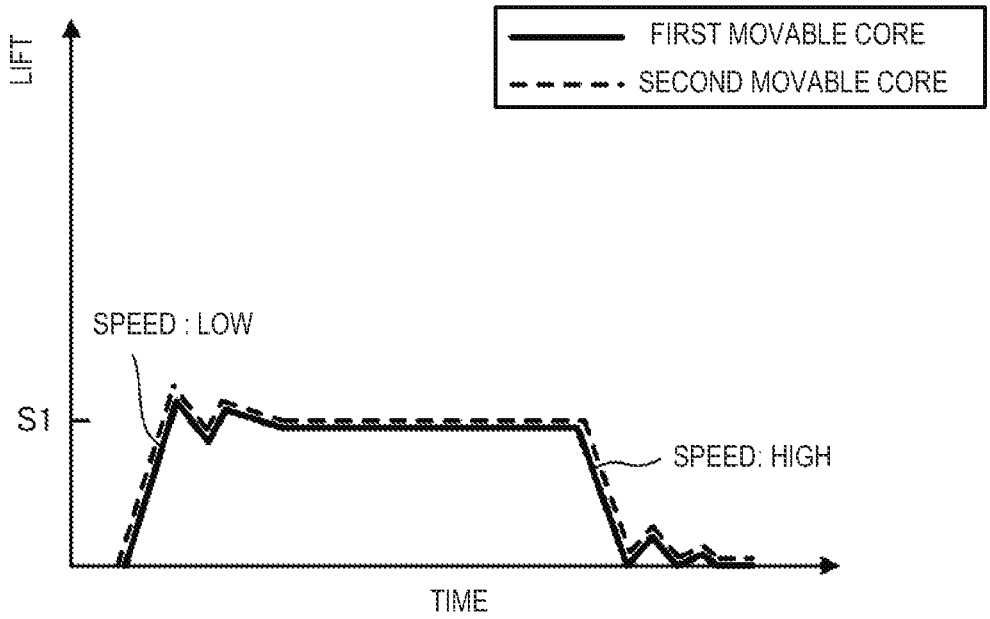
FIG. 10B is a chart showing a lift state of a movable core of the injector shown in FIG. 9 when the power is supplied only to the second solenoid coil.

On the other hand, when the power is supplied to the first solenoid coil 81, as indicated by the broken line in FIG. 10B, the first movable core 871 moves, and accordingly, as indicated by the solid line in FIG. 10B, the needle 83 and the second movable core 872 respectively stroke upwardly by the predetermined stroke amount S1. Here, since the downward biasing force by the spring 882 acts on the first movable core 871, the elevating speed of the needle 83 and the like is smaller compared to the embodiment shown in FIG. 8B. Moreover, when the power supply to the first solenoid coil 81 ends, the first and second movable cores 871 and 872, and the needle 83 descend integrally according to the difference between the downward biasing force of the springs 881 and 882 and the upward biasing force of the spring 883, and therefore, the descending speed of the needle 83 becomes faster compared to the embodiment shown in FIG. 8B.

Note that, although the illustration is omitted, for both embodiments shown in FIGS. 5 and 9, the spring 883 may be arranged on the second movable core 872 so as to apply a downward biasing force on the second movable core 872.

Moreover, in the injectors 80 shown in the FIGS. 5 and 9, the solenoid coil with relatively large stroke amount, in other words, the second solenoid coil 82 is arranged on the upper side, and the solenoid coil with relatively small stroke amount, in other words, the first solenoid coil 81 is arranged on the lower side; however, the opposite arrangement may be applied, in which the solenoid coil with relatively large stroke amount is arranged on the lower side, and the solenoid coil with relatively small stroke amount is arranged on the upper side with respect to each other.

(Structure for Reducing Attraction Force Increasing Due to Fuel Pressure Increase of Injector)

In the injector 80 of the embodiment having the structure in which the needle is arranged within the fuel passage 800, the back pressure due to the fuel pressure acts on the needle 83 in a valve closed state. In other words, the load acting in an opening direction (separating direction) of the needle 83 acts on the needle 83. The back pressure is in proportion to the level of the fuel pressure, and when the fuel pressure is set high as the injector 80 described herein, the back pressure which acts on the needle 83 increases. The back pressure has influence on the attraction force of the solenoid coils 81 and 82 when opening the needle 83 from the seat portion, and a required attraction force increases as the back pressure is larger. Therefore, in this injector 80, a diameter of the seat portion 801 where the tip portion of the needle 83 is seated thereon is set small so that the attraction force required for opening the needle 80 becomes small.

Figure 11A:
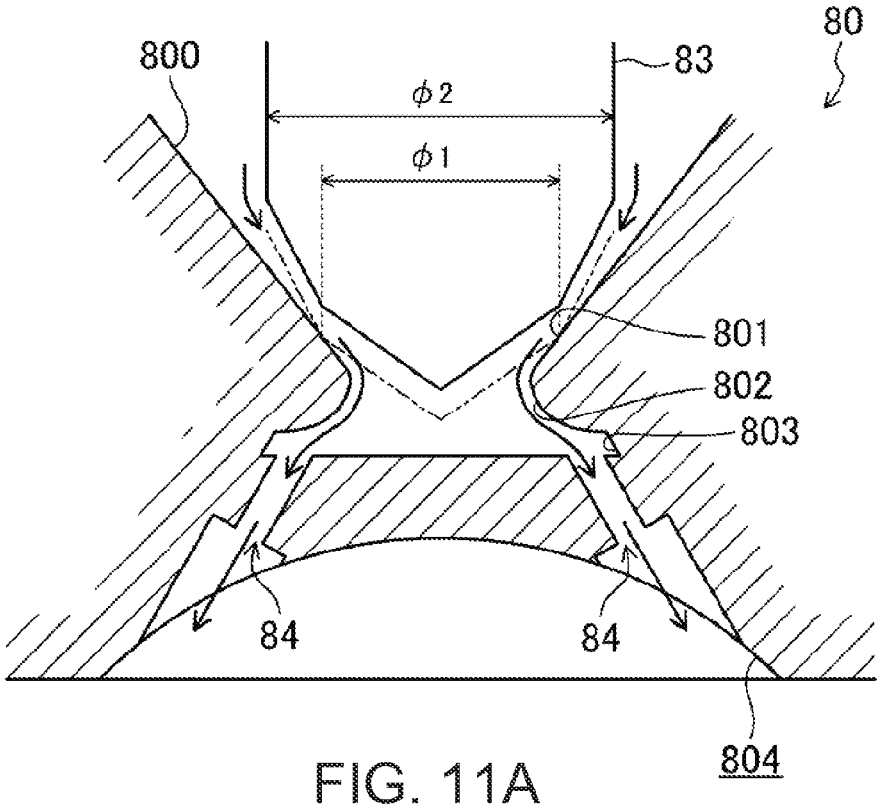
FIG. 11A is an enlarged cross-sectional view showing a configuration of a tip portion of the injector.
Figure 11B:
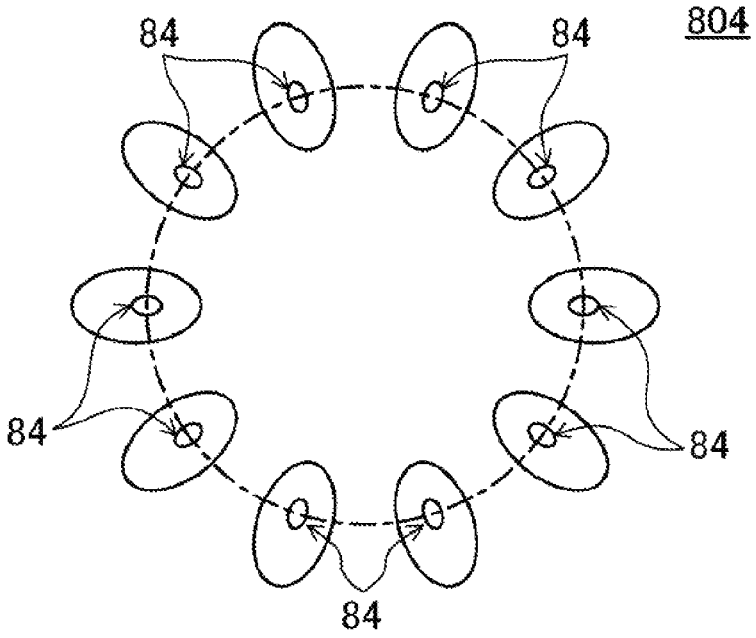
FIG. 11B is a bottom view illustrating an arrangement of nozzle holes provided to the injector.

FIGS. 11A and 11B show a configuration of the tip portion of the injector 80. The tip portion of the needle 83 is formed to taper, and as indicated by the two-dot chain line in FIG. 11A, the seat portion 801 is configured so that an intermediate area of the tapering tip portion of the needle 83 is seated thereon and separated therefrom. Thus, the diameter of the seat portion 801 is smaller than a diameter $\phi$2 of a substantially cylindrical portion of the tip portion of the needle 83. In the state where the needle 83 is seated on the seat portion 801, although the back pressure which acts on the needle 83 due to the fuel pressure is in proportion to the diameter of the seat portion 801, by setting the diameter of the seat portion 801 small as described above to reduce the area thereof, the back pressure which acts on the needle 83 can accordingly be reduced. Note that, in the state where the needle 83 is seated on the seat portion 801, in the tip portion of the needle 83, the fuel pressure acts on a surface inclining toward the axial direction. Although a force which the fuel pressure acts in the axial direction (opening direction) of the needle 83 corresponds to a cos (cosine) component, since the pressure reception area increases according to the inclination, a reduction of the force acting in the axial direction of the needle 83 by the cos component is compensated.

The reduction of the back pressure acting on the needle 83 reduces the attraction force required for opening (separating) the needle 83. This is advantageous in minimizing the first and second solenoid coils 81 and 82. The minimization of the first and second solenoid coils 81 and 82 enables minimizing the diameter of the injector 80, and thus, is advantageous in securing an attaching space of the injector 80 attached in the cylinder head 12 of the engine 1 to be oriented along the axis of the cylinder 18 as shown in FIG. 1. The reduction of the attraction force is also advantageous in saving power. Note that, since the tip end of the needle 83 is tapered, when the needle 83 is separated from the seat portion 801, the fuel flowing through the seat portion 801 is guided along the inclining face of the tip portion of the needle 83 and, thus, a flow resistance is reduced. Therefore, the fuel pressure on a side of the throttled portion 802 easily increases. Since this increase of the fuel pressure increases leads to the increase of the force acting on the needle 83 in the opening direction, it is advantageous in reducing the attraction force required for opening the needle 83.

The throttled portion 802 is provided continuously to the seat portion 801 minimized as above. The throttle portion 802 is configured to have a smaller diameter than the diameter of the seat portion 801. Moreover, an enlarged portion 803 where the diameter is enlarged is provided continuously to the throttled portion 802. A portion from the throttled portion 802 to the enlarged portion 803 is formed in a curved surface shape where its inner wall is smooth, such that the fuel flow from the seat portion 801, through the throttled portion 802, and to the enlarged portion 803, is smooth. The enlarged portion 803 is communicated with a plurality of (in FIG. 11B, ten) nozzle holes 84, and as shown in FIG. 11B, the ten nozzle holes 84 are formed in the tip face 804 of the injector 80 concaved in a spherical shape for acting against the high fuel pressure, and are arranged circumferentially via an equal space.

By communicating the ten nozzle holes 84 with the enlarged portion 803 where the diameter is enlarged as described above, each space between the nozzle holes 84 can sufficiently be secured in the tip face 804 of the injector 80. In this manner, the atomization of the fuel to be injected through each nozzle hole 84 becomes favorable by the high fuel pressure. The favorable atomization of the injected fuel is, particularly within a low-engine-load range where the compression-ignition combustion is performed, advantageous in forming homogeneous lean mixture gas and can stabilize the compression-ignition combustion.

Figure 12:
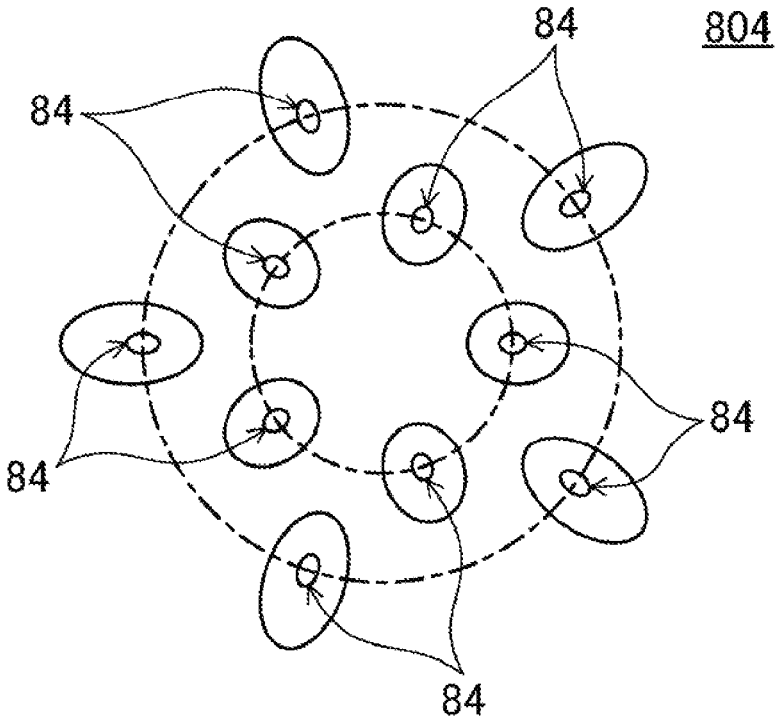
FIG. 12 is a bottom view illustrating a different arrangement of the nozzle holes.

Note that, the arrangement of the holes is not limited to the circumferential arrangement as shown in FIG. 11B, and as shown in FIG. 12, the plurality of (in FIG. 12, ten) nozzle holes 84 may be arranged to form two circles (one of the circles is positioned on the inside and the other circle is positioned on the outside) in the radial direction. Moreover, the number of the holes may suitably be set.

(Relation Between Operation of Two-Stage Solenoid Injector and Operating Range of Engine)

In the injector 80 having such a configuration as the embodiment, as described above, when the power is supplied to the first solenoid coil 81, the needle 83 can stroke by the first stroke amount S1, and when the power is supplied to the second solenoid coil 82, the needle 83 can stroke by the second stroke amount S2. Here, the first stroke amount S1 and the second stroke amount S2 are set to satisfy S1<S2, and thereby, the injector 80 is configured to stroke the needle 83 by the different stroke amounts and inject the fuel.

As shown in FIG. 2, the PCM 10 outputs the control current to both or either one of the first and second solenoid coils 81 and 82 of the injector 80 to inject a required amount of fuel into the cylinder 18 so as to achieve a required fuel injection amount according to the operating state of the engine 1. In other words, when the required fuel injection amount is small, specifically, in the CI mode where the compression-ignition combustion is performed within the operating range shown in FIG. 3, the power is supplied to the first solenoid coil 81. In this manner, the PCM 10 opens the needle 83 via the first movable core 871, holds the needle 83 at the stroke amount S1 (i.e., small stroke), and then ends the power supply. Thus, the needle 83 is closed (seated). Moreover, as shown in FIG. 6, a waveform of an instantaneous injection rate in terms of time is formed to have a predetermined trapezoid shape by the control of the PCM 10. As a result, the injection accuracy with a comparatively small injection amount is improved. In the CI mode, since the homogeneous lean mixture gas is formed by performing the fuel injection within the intake stroke period, even when some extent of variation occurs in the fuel injection amount, the stability of the compression-ignition combustion can sufficiently be secured.

On the other hand, when the required fuel injection amount is large, specifically, in the SI mode where the spark-ignition combustion is performed within the operating range shown in FIG. 3, the power is supplied to at least the second solenoid coil 82 so as to open the needle 83 via the second movable core 872. Then the needle 83 is held at the stroke amount S2 (i.e., large stroke), the power supply ends thereafter, and the needle 83 is closed (seated). Moreover, as shown in FIG. 6, a waveform of an instantaneous injection rate in terms of time is formed to have a similar trapezoid shape to the waveform at the small stroke by the control of the PCM 10. As a result, the injection accuracy with a comparatively large injection can also be improved. Especially, within the ranges (1) and (2) of the operating range shown in FIG. 3, a high injection rate is required since the high pressure retarded injection is performed. This requirement can be achieved by stroking the needle 83 with the high fuel pressure by the comparatively large second stroke amount S2, and the required amount of fuel can be injected into the cylinder 18 near the compression TDC in a short period of time with the high fuel pressure.

Here, when stroking the needle 83 by the second stroke amount S2, it may be such that the power is only supplied to the second solenoid coil 82, or both the first and second solenoid coils 81 and 82. In the case of supplying the power to both the first and solenoid coils 81 and 82, the power is preferably supplied to the first solenoid coil 81 in the start of the opening operation of the needle 83. In other words, in the start of the opening operation of the needle 83, it is required to generate the attraction force acting against the back pressure caused by the fuel pressure and acting on the needle 83, and the biasing force by the spring 881. Since the gap 51 between the first movable core 871 and the first fixed core 861 for the first solenoid coil 81 is smaller than the gap S2 between the second movable core 872 and the second fixed core 862 for the second solenoid coil 82, a current value required for generating the attraction force becomes low. Moreover, after the needle 83 is separated from the seat portion 801, the back pressure due to the fuel pressure is eliminated, and thus, the attraction force required for the stroke of the needle 83 becomes smaller accordingly. Therefore, only a small supply amount of the power for the second solenoid coil 82 is required. In other words, in stroking the needle 83 by the second stroke amount S2, the power supply to the first solenoid coil 81 in the start of the opening operation of the needle 83 can suppress a total consumption power. Note that, the power supply to the second solenoid coil 82 may be started after a predetermined period of time from the start of the power supply to the first solenoid coil 81, or may be started when the power supply to the first solenoid coil 81 starts.

As above, the injector 80 is used, which has two kinds of first and second solenoid coils 81 and 82 and is capable of changing the stroke amount of the needle 83 between the first and second stroke amounts S1 and S2 by the coils. Thereby, within the low-engine-load range where the fuel injection amount is relatively small, by only operating the first solenoid coil 81, the small amount of fuel can accurately be injected, and the stability of the compression-ignition combustion can be secured. On the other hand, within the high-engine-load range where the fuel injection amount is relatively large, especially within an area where the high pressure retard injection is performed, by operating at least the second solenoid coil 82, the high injection rate is achieved as well as the high fuel pressure, the required amount of fuel can be injected into the cylinder near the compression TDC in the short period of time with the high fuel pressure, and thus, it becomes advantageous in avoiding the abnormal combustion. As a result, the fuel consumption can be improved over a wide operating range of the engine 1.

(Configuration of High Pressure Fuel Pump)

Figure 13:
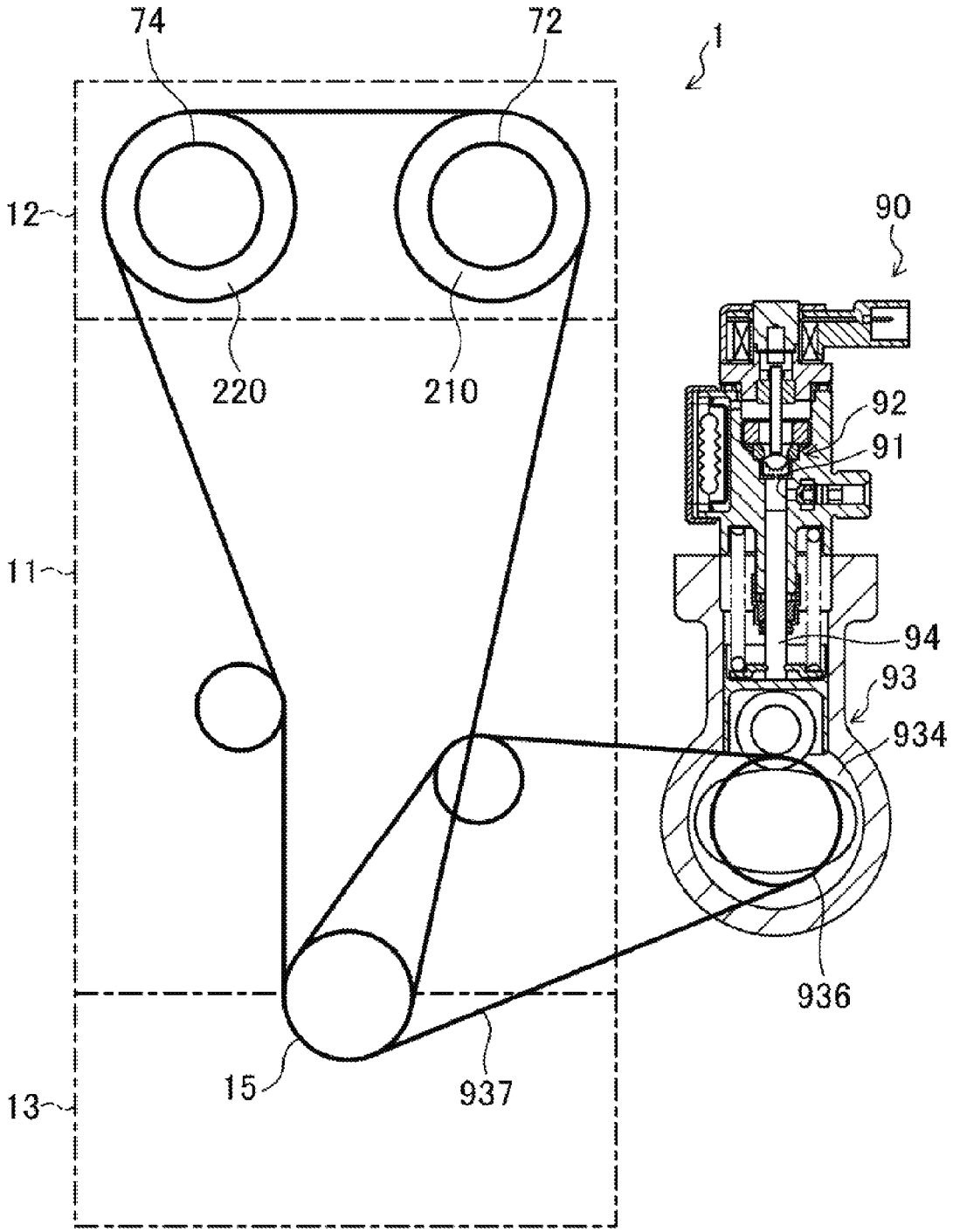
FIG. 13 is a schematic chart showing an arranging relation and a coupling relation between the engine and a high pressure fuel pump.
Figure 14C:
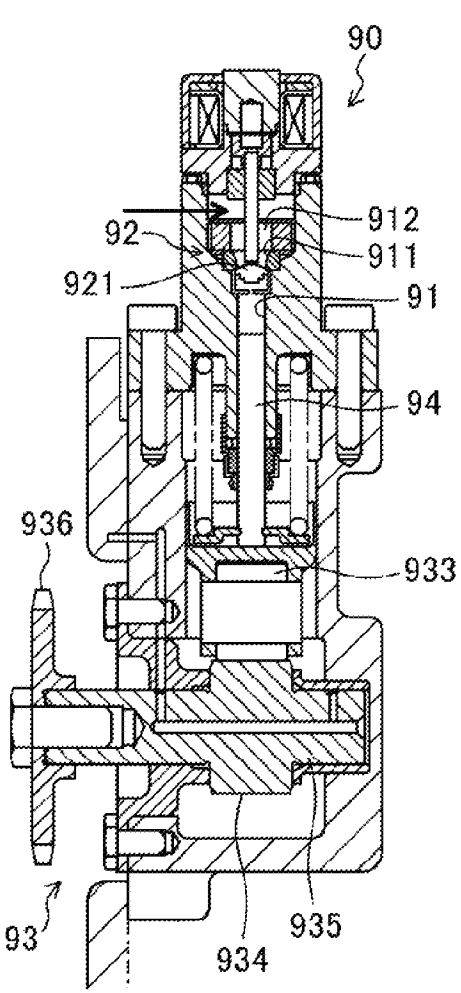
FIG. 14C is a cross-sectional view of the pump taken along a line C-C in FIG. 14B.
Figure 14B:
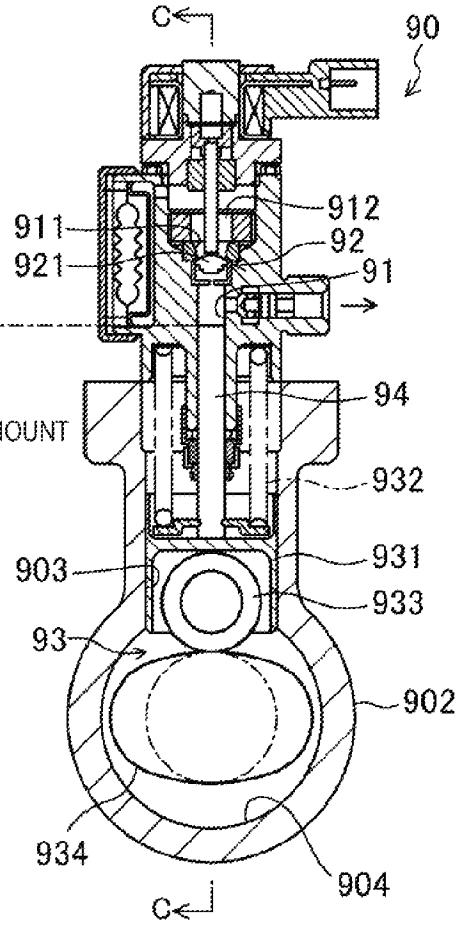
FIG. 14B is a cross-sectional view showing a configuration of the high pressure fuel pump in a state where the plunger is positioned at a bottom dead center.
Figure 14A:
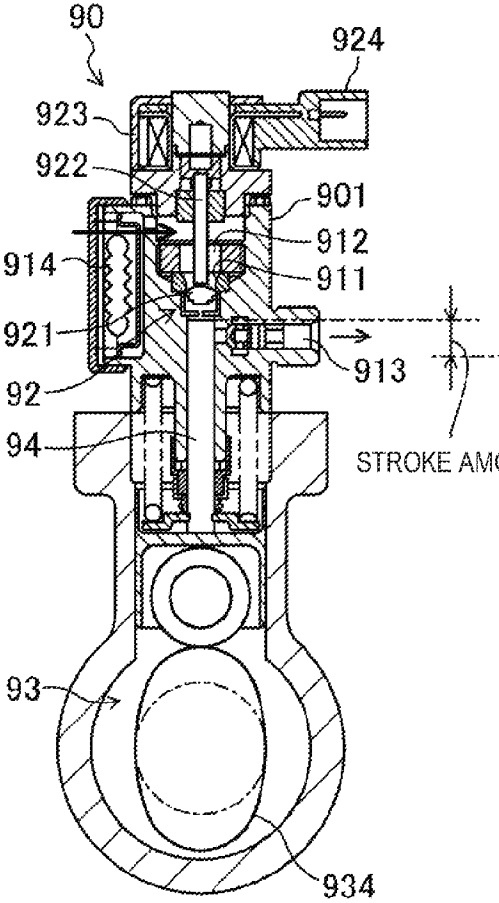
FIG. 14A is a cross-sectional view showing a configuration of a high pressure fuel pump in a state where a plunger is positioned at a top dead center.
Figure 15:
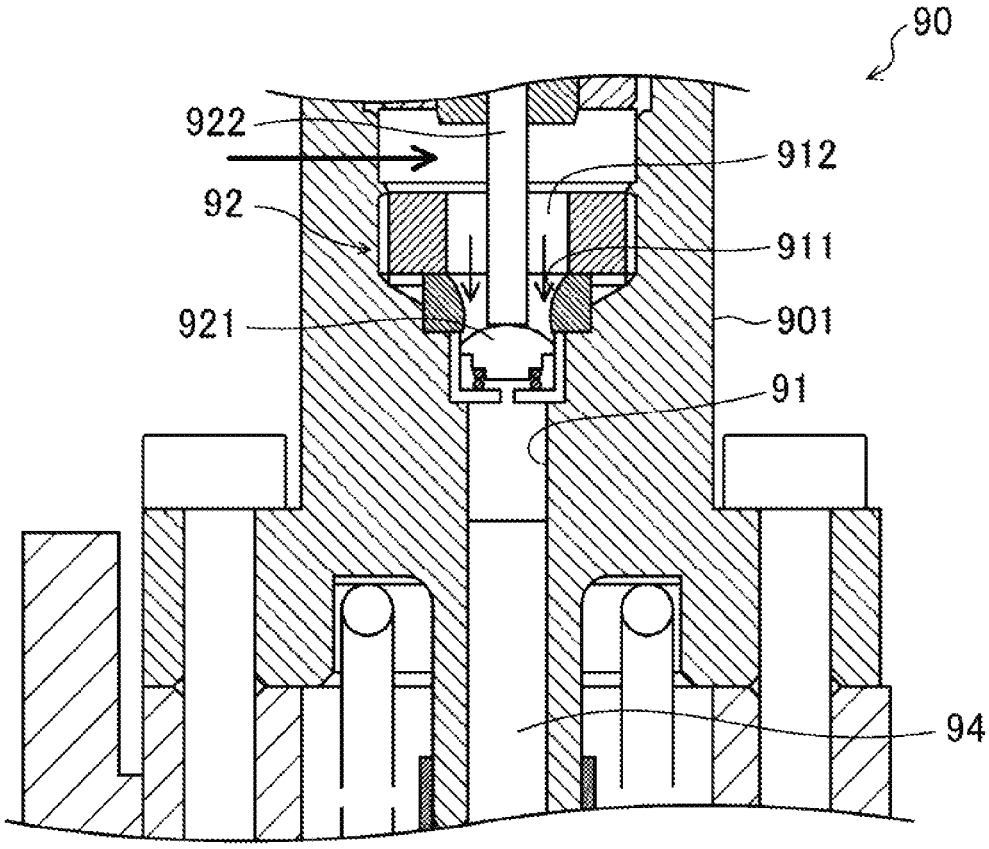
FIG. 15 is an enlarged cross-sectional view showing a structure of the high pressure fuel pump near an intake valve.

FIGS. 13 to 15 show the configuration of the high pressure fuel pump 90. As described above, in the engine 1 of the embodiment, the fuel containing gasoline is injected with the high fuel pressure within a range between 40 MPa and about 120 MPa at maximum. Therefore, the high pressure fuel pump 90 has a different configuration from the conventional plunger-type fuel pump.

In other words, as shown in FIGS. 14A to 14C, the high pressure fuel pump 90 includes a cylinder 91 arranged to extend in the up-and-down directions, a plunger 94 inserted into the cylinder 91, and an operation mechanism 93 for stroking the plunger 94 within the cylinder 91 in the up-and-down directions.

As shown in FIG. 15, the cylinder 91 is formed within a first casing 901, and an introduction port 911 for introducing the fuel into the cylinder 91 is provided in an upper end portion of the cylinder 91. Moreover, although the detailed illustration is omitted, a supply chamber 912 where the fuel transmitted from the fuel tank (see the thick solid arrow line in FIG. 14) is formed within the first casing 901. The introduction port 911 formed in the upper end portion of the cylinder 91 is communicated with the supply chamber 912. The supply chamber 912 has a diameter same as or larger than the diameter of the cylinder 91, and is configured such that the diameter gradually becomes smaller toward the introduction port 911.

An inlet valve 92 is attached to the introduction port 911, and the fuel flows into the cylinder 91 from the supply chamber 912 when the inlet valve 92 opens the introduction port 911. The inlet valve 92 has a valve body 921 biased upwardly to be seated on the introduction port 911, and the valve body 921 normally closes the introduction port 911, whereas, as described later, when the valve body 921 is pushed downwardly, it opens the introduction port 911 to allow the fuel to flow into the cylinder 91 from the introduction port 911 (see FIG. 15).

The inlet valve 92 also has a rod 922 arranged on the upper side of the valve body 921 to extend in the up-and-down directions, and a lower end of the rod 922 contacts with an upper end surface of the valve body 921, while an upper end of the rod 922 passes inside the supply chamber 912 to reach above the supply chamber 912. The rod 922 reciprocates in the up-and-down directions by a solenoid coil 923 attached on the first casing 901. In other words, when the power is supplied to the solenoid coil 923 via a coupler 924 provided at an upper end of the high pressure fuel pump 90, the rod 922 moves downwardly to push down the valve body 921 which is biased upwardly, so as to open the introduction port 911 by separating the valve body 921 from the introduction port 922. Thus, the fuel flows into the cylinder 91. On the other hand, when the power supply to the solenoid coil 923 is stopped, the valve body 921 is lifted by the upward biasing force, thereby, the valve body 921 is seated in the introduction port 911, and thus, the introduction port 911 is closed. In this manner, the inlet valve 92 is configured as an electromagnetic valve which is controlled to open and close by the PCM 10.

As shown in FIGS. 14A and 14B, a discharge port 913 for discharging a high pressure fuel from the cylinder 91 is provided on one side of the cylinder 91 near its upper end portion. Note that, the reference numeral 914 in FIG. 14A is a pulsation dumper 914 arranged on the introduction side of the high pressure fuel pump 90 and for suppressing pulsation due to the fuel injection buy the injector 80.

The plunger 94 is inserted into the cylinder 91 as described above and strokes in the up-and-down directions by the operation mechanism 93 (described later). When the plunger 94 descends from its top dead center shown in FIG. 14A, the fuel inside the supply chamber 912 passes through the introduction port 911 which is opened corresponding to the timing, and flows into the cylinder 91. When the introduction port 911 is closed, the plunger 94 elevates from its bottom dead center shown in FIG. 14B, and thus, the fuel pressure inside the cylinder 91 increases, and the compressed fuel passes through the discharge port 913 to be discharged from the high pressure fuel pump 90 toward the fuel rail 64.

The operation mechanism 93 includes a piston 931 to which a lower end of the plunger 94 is fixed and which is reciprocatable in the up-and-down directions, a spring 932 downwardly biasing the piston 931, a roller 933 attached to the piston 931, and a cam 934 for stroking the plunger 94 in the up-and-down directions via the roller 933 and the piston 931.

The piston 931 is inserted into a piston accommodation 903 having a circular shape in its cross section and formed in a second casing 902 attached to the lower side of the first casing 901, and the piston 931 reciprocates in the up-and-down directions within the piston accommodation 903.

The roller 933 (not illustrated in detail) is attached to the piston 931 to be rotatable about an axis perpendicular to the stroke direction of the plunger 94 (i.e., the up-and-down direction in FIGS. 14A to 14C) via a rolling bearing or a sliding bearing (see FIG. 14C). The roller 933 reduces a friction resistance with the cam 934, and is advantageous in reducing an operation torque of the high pressure fuel pump 90 and, as a result, reducing the mechanical resistance loss of the engine 1.

Inside the second casing 902, a cam accommodation 904 is also formed continuously to a lower end of the piston accommodation 903. The cam 934 is arranged to be supported by a camshaft 935 within the cam accommodation 904 so as to be rotatable about an axis perpendicular to the stroke direction of the plunger 94. As clearly shown in FIGS. 14A and 14B, the cam 934 has two cam noses, and the cam noses are formed on both sides with respect to the rotation central axis of the cam 934. The camshaft 935 is, as conceptually shown in FIG. 13, operatingly coupled to the crankshaft 15 of the engine 1 via a sprocket 936 fixed to a tip portion of the camshaft 935 and a chain 937 wound around the sprocket 936. The camshaft 935 of the operation mechanism 93 is operated to rotate at a reduction ratio of 1:1 with the crankshaft 15 of the engine 1.

Here, since the operation mechanism 93 of the high pressure fuel pump 90 is operatingly coupled to the crankshaft 15, as shown in FIG. 13, the operation mechanism 93 is arranged at a position closer in height to the crankshaft 15 than the camshafts 210 and 220 of the engine 1. Moreover, as described above, in the high pressure fuel pump 90, the introduction port 911 is formed at the upper end of the cylinder 91 extending in the up-and-down direction and is communicated with the supply chamber 912 provided above the cylinder 91, and the solenoid coil 923 for operating the inlet valve 92 is arranged further above the supply chamber 912. Thus, even though the total height of the high pressure fuel pump 90 is set comparatively high, as described above, by arranging the voluminous high pressure fuel pump 90 at the comparatively low position in height on one side of the engine 1, the high pressure fuel pump 90 can be arranged within the total height of the engine, resulting in an advantageous layout inside the engine room.

The high pressure fuel pump 90 having the above configuration achieves a high fuel pressure, i.e., 40 MPa or above. Therefore, the volume of the cylinder 91 when the plunger 93 is at the top dead center is set significantly small. In other words, since the fuel pressure increase will bring attention to the compression property of the fuel, by setting the cylinder volume in the top dead center state small, both obtaining the high fuel pressure and securing the discharge flow rate can be achieved.

However, due to the reduced cylinder volume in the top dead center state, when the plunger 94 descends to introduce the fuel into the cylinder 91, the pressure inside the cylinder 91 is reduced greatly. With the fuel containing gasoline, this pressure drop causes cavitation near the introduction port 911, and it may become difficult for the fuel to flow into the cylinder.

Thus, in the high pressure fuel pump 90 having the above configuration, by providing the supply chamber 912 having a comparatively large volume, when the inlet valve 92 is opened, as indicated by the arrow in FIG. 15, the fuel flows from the supply chamber 912 in the axial direction of the cylinder 91 (i.e., in the stroke direction of the plunger 94), passes the introduction port 911, and further flows into the cylinder 91. Such a configuration smoothen the flow of the fuel into the cylinder 91, and suppresses the occurrence of cavitation due to the pressure drop caused while the supply chamber 912 descends. Here, since the supply chamber 912 is formed to gradually narrow in diameter towards the fuel flowing direction, the flow of the fuel can be smoothened. As a result, the fuel can surely flow into the cylinder 91, and in the high pressure fuel pump 90, both obtaining the high fuel pressure of 40 MPa or above and securing a required fuel discharge amount can be achieved.

Moreover, in the high pressure fuel pump 90 with the increased fuel pressure, a load which acts on the operation mechanism 93 increases by a reaction force produced when the plunger 94 reaches the top dead center. Therefore, in order to withstand the large load, the operation mechanism 93 may be increased in size. Especially, if the roller 933 of the operation mechanism 93 is to be supported to the piston 931 via the rolling bearing, the roller and the rolling bearing are increased significantly in size. Thus, with the high pressure fuel pump 90 having the above configuration, the cylinder diameter and the plunger diameter are reduced so that the load which acts on the operation mechanism 93 is reduced. Further, for the purpose of achieving the high fuel pressure, the stroke amount of the plunger 94 is set comparatively large (see FIGS. 14A and 14B). As a result, the high pressure fuel pump 90 is configured to be a long stroke-type in which the stroke amount of the plunger 94 is larger than the cylinder diameter. This achieves both minimization and high fuel pressure of the high pressure fuel pump 90.

Additionally, the configuration of the cam 934 of the operating mechanism 93 to having the two cam noses is applicable to the long stroke of the plunger 94 described above and, also, can avoid the size increase of the cam by comparatively increasing the lift of each cam nose. This is because, with the two cam noses, the cam noses are arranged on both sides of the cam 934 with respect to its central axis, and thus, even when either one of the cam noses is formed higher, the other cam nose is not affected. Therefore, the configuration of the cam 934 of the operating mechanism 93 to have the two cam noses also contributes in achieving both minimization and high fuel pressure of the high pressure fuel pump 90.

Since the cam 934 of the operation mechanism 93 is configured to have the two cam noses to rotate at a constant speed with respect to the crankshaft 15, the high pressure fuel pump 90 discharges the fuel for four times while the crankshaft 15 performs two rotations. In the four-cylinder four-cycle engine 1, this enables to discharge the fuel corresponding to one fuel injection by each of the four cylinders 18. Thus, the adoption of the two cam noses is also advantageous in operatingly coupling the operation mechanism 93 to the crankshaft 15.

With the high pressure fuel pump 90 configured to discharge the fuel with a high fuel pressure, its operation torque also becomes significantly large compared to the conventional high pressure fuel pump. If the high pressure fuel pump 90 with such a high operation torque is attached to an end portion of the intake camshaft 210 or the exhaust camshaft 220 similar to the conventional case, the VVT 72 or 74 cannot be operated even when desired (i.e., the camshaft 210 or 220 does not rotate). However, as described above, the high pressure fuel pump 90 is operatingly coupled to the crankshaft 15 as shown in FIG. 13, and therefore, it does not influence on the operation of the VVTs 72 and 74 attached to the intake and exhaust camshafts 210 and 220, respectively. The operatingly coupling the high pressure fuel pump 90 where the high fuel pressure is achieved, to the crankshaft 15 as described above is also advantageous in securing the operation of the VVTs 72 and 74 attached to the camshafts.

Note that, the operating range (map) shown in FIG. 3 is merely an illustration, and the application of the art disclosed here is not limited to the engine which the map shown in FIG. 3 is set. The map may suitably be changed.

Moreover, the art disclosed here is not limited to the naturally aspired engine as described above, and can be applied to an engine with a forced induction system. In the engine with the forced induction system, the range for the CI mode can be expanded to the high-engine-load side.

It should be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

DESCRIPTION OF REFERENCE NUMERALS

1 Engine
10 PCM (Controller)
15 Crankshaft
18 Cylinder
210 Intake Camshaft
220 Exhaust Camshaft
72 VVT (Intake Side)
74 VVT (Exhaust Side)
80 Injector (Fuel Injection Valve)
800 Fuel Passage
801 Seat Portion
802 Throttled Portion
803 Enlarged Portion
81 First Solenoid Coil
82 Second Solenoid Coil
83 Needle (Needle Body)
84 Nozzle Hole
841 First Valve Body

842 Second Valve Body
85 Case
871 First Movable Core
872 Second Movable Core
891 First Kind Reinforcing Member
892 Second Kind Reinforcing Member
90 High Pressure Fuel Pump
91 Cylinder
911 Introduction Port
92 Inlet Valve
923 Solenoid Coil
93 Operation Mechanism
934 Cam with Two Noses
94 Plunger

The invention claimed is:

1. A fuel injection valve of a direct injection engine for directly injecting fuel containing gasoline into a cylinder of the engine, comprising:

a valve body with a nozzle hole, facing inside the cylinder, formed at a tip thereof;

a cylindrical case arranged inside the valve body and forming a fuel passage by an inner circumferential surface of the case;

a cylindrical fixed core having a fitting portion fixed to the inner circumferential surface of the cylindrical case, so that a fuel pressure acts on portions of the fixed core other than the fitting portion of the fixed core;

a needle body provided inside the fixed core for opening and closing the nozzle hole, configured to be moved in a cylinder axial direction by at least one movable core;

the at least one movable core movably provided inside the case in the cylinder axial direction and for driving the needle body to open and close, so that the needle body is movably provided inside the fixed core;

a solenoid coil arranged inside the valve body and outside the case and configured for attracting the at least one movable core by forming a magnetic circuit over the inside and outside of the case when power is supplied to the solenoid coil, so that the needle body opens the nozzle hole; and a reinforcing member arranged inside the valve body and fitted externally onto the case, wherein a maximum fuel pressure inside the fuel passage is set to a high fuel pressure of 40 MPa or above.

2. The valve of claim 1, wherein the reinforcing member includes a magnetic body arranged adjacent to the solenoid coil in the cylinder axial direction and constituting a part of the magnetic circuit.

3. The valve of claim 2, wherein the magnetic body is made of ferrite steel.

4. The valve of claim 1, wherein the reinforcing member includes a non-magnetic body intervening between the solenoid coil and the case.

5. The valve of claim 4, wherein the non-magnetic body is made of austenite steel.

* * * * *